US006259887B1

(12) United States Patent
Awano

(10) Patent No.: US 6,259,887 B1
(45) Date of Patent: Jul. 10, 2001

(54) IMAGE FORMING APPARATUS

(75) Inventor: Hiroaki Awano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/356,451

(22) Filed: Jul. 19, 1999

(30) Foreign Application Priority Data

Aug. 11, 1998 (JP) ..... 10-227258
Feb. 25, 1999 (JP) ..... 11-049110

(51) Int. Cl.[7] ..... G03G 15/00; G03G 21/00
(52) U.S. Cl. ..... 399/390; 399/406
(58) Field of Search ..... 399/390, 322, 399/341, 406, 16, 389; 162/270, 271

(56) References Cited

U.S. PATENT DOCUMENTS 4,652,110 * 3/1987 Sato et al. ..... 399/406
5,850,589 * 12/1998 Cruz et al. ..... 399/341
5,920,759 * 7/1999 Ushiroji et al. ..... 399/406

FOREIGN PATENT DOCUMENTS 7-7229 1/1995 (JP) .
7-60274 6/1995 (JP) .
7-60275 6/1995 (JP) .
7-72814 8/1995 (JP) .
2-2555092 8/1996 (JP) .
8-248845 9/1996 (JP) .
2-2600748 1/1997 (JP) .
9-171332 6/1997 (JP) .
9-269707 10/1997 (JP) .
10-1247 1/1998 (JP) .

* cited by examiner

*Primary Examiner*—Sophia S. Chen
(74) *Attorney, Agent, or Firm*—Oliff & Berridge, PLC

(57) ABSTRACT

A cut sheet is forcibly humidified.

A cut sheet S travels upward between a pair of guide plates 65 and 66 facing each other. The guide plates 65 and 66 are respectively formed with openings 67 and 68 across which linear bodies 69 and 70 are stretched. A sprinkler 30 sprinkles water droplets toward the opening 67 to supply moisture to the cut sheet S traveling between the guide plates 65 and 66.

20 Claims, 27 Drawing Sheets

CONNECTOR PORTION

MILLING PORTION

MELT TANK PORTION

NIPPING PORTION

IMAGE FORMING APPARATUS

BACKGROUND OF THE INVENTION

1. Field of the Invention

The present invention relates to an image forming apparatus for forming images on cut sheets, a sheet humidifier for supplying moisture to cut sheets and a binding system including them.

2. Description of the Related Art

Electrophotographic image formation is generally carried out by transporting cut sheets having toner electrostatically absorbed thereon through a fuser to fuse the toner on to the sheets.

As shown in FIG. 1, however, the fusing of toner with a fuser results in the loss of a considerable amount of moisture included in cut sheets of paper, which reduces the sheet dimensions from initial values. Although the sheet dimensions are recovered because the sheets absorb moisture again as time passes, the fluctuation of dimensions results in various problems. For example, when dry sheets are collected and bound, the glued portion on the back of the book is fixed in a shrunk state. Although each sheet returns to the initial dimensions as a result of subsequent absorption of moisture, "wavy" distortions remain on each sheet because it is constrained by glue in the region of the back. Specifically, as shown in FIG. 2, a book can become wavy as time passes even if it has been beautifully produced.

Further, when a cut sheet is extremely dry before an image is formed, the quality of the image formed thereon can be adversely affected.

The present invention has been conceived taking the above-described situation into consideration, and it is an object of the invention to provide an image forming apparatus, a sheet humidifier and a binding system in which cut sheets can be humidified by force.

SUMMARY OF THE INVENTION

In order to solve the above-described problems, according to the invention, there is provided a sheet humidifier comprising:

transport means for transporting a cut sheet;

at least a pair of sheet guide portions facing each other for allowing the cut sheet transported by the transport means to pass therebetween in one direction and for exposing front and rear sides of the cut sheet; and a sprinkler provided outside the sheet guide portions for sprinkling water droplets toward one of the sheet guide portions to supply moisture to the cut sheet passing between the sheet guide portions.

According to the invention, a cut sheet subjected to a heating process passes between a pair of sheet guide portions. Since the sheet guide portions expose the front and rear sides of the cut sheet, water droplets sprinkled by the sprinkler land on the cut sheet while it passes therethrough. That is, the sheet guide portions guide the cut sheet and simultaneously maintains an area on the sheet where water droplets are to be sprinkled. This makes it possible to forcibly supply moisture to the cut sheet.

Each of the sheet guide portions may include a plurality of linear bodies disposed substantially on the same plane to allow water droplets to pass between the linear bodies. This allows a cut sheet to be easily guided and simultaneously maintains an area on the sheet where water droplets are to be sprinkled.

At least some of the linear bodies may be at an angle to the traveling direction of the cut sheet so that the intervals between the linear bodies increase with the distance traveled by the cut sheet downward.

In this case, even if the sheet is skewed, the no corner of the sheet will be caught by the linear bodies because the intervals between the linear bodies increase with the distance traveled the cut sheet downward, and the possibility of jamming or bending is thus reduced. Since the linear bodies are at an angle to the traveling direction of the sheet, regions of the sheet which have been blocked by the linear bodies from water droplets are exposed to water droplets as the sheet proceeds. This makes it possible to increase the humidified area.

The linear bodies are preferably thinner than the diameter of normal water droplets sprinkled by the sprinkler. With such thin linear bodies, the area on the cut sheet wetted by water can be increased.

Each of the sheet guide portions may include a plate member formed with a plurality of holes through which water droplets can pass. This allows a cut sheet to be easily guided and simultaneously maintains an area on the sheet where water droplets are to be sprinkled.

The intervals between the holes are preferably smaller than the diameter of the normal water droplets sprinkled by the sprinkler. Thus, the area on the cut sheet welled by water can be increased.

In the sheet humidifier, the cut sheet may travel substantially upward;

the sheet guide portion closer to the sprinkler may be formed with an opening across which the linear bodies are stretched and provided with an edge serving as an upper end of the opening;

the edge may be tapered such that it is spaced from the linear bodies at an interval that increases as it extends downward; and the opening may not be located directly under the edge in the vertical direction.

Therefore, when water droplets hit regions of the sheet guide portions above the opening, the water droplets drop from the edge. Since the opening is not located directly under the edge in the vertical direction, the dropping water droplets will not directly land on the sheet passing there. Thus, partial non-uniformity of the water content in the sheet is reduced to reduce the occurrence of wrinkles and breakage.

The sheet humidifier may include a water container disposed opposite to the sprinkler across a position where the cut sheet transported by the transport means passes for receiving water droplets which have been sprinkled by the sprinkler but have not hit the cut sheet. This makes it possible to prevent a great number of water droplets which have been sprinkled by the sprinkler but have not hit the cut sheet from dropping upon underlying components, which can cause problems in the components.

A cushion member may be provided which is disposed in the water container for being hit by the water droplets to suppress reflection. Such a cushion member prevents water droplets once contained in the water container from exiting through both openings. This consequently reduces the possibility of problems caused by water dropping upon underlying components. The collection of water with the water container makes it possible to achieve an improved collection ratio.

The sprinkler may be enclosed by a housing formed with a slit through which water droplets sprinkled by the sprinkler pass, and the slit may limit the range of the water droplets sprinkled by the sprinkler in the traveling direction of the cut sheet.

By limiting the range of sprinkled water droplets with the slit as described above, the area wetted by the sprinkled water droplets can be minimized to prevent wetting in unwanted regions. This consequently reduces the possibility of problems caused by water dropping upon underlying components. The collection of water with the water container makes it possible to achieve an improved collection ratio. In addition, since it is possible to prevent water droplets from being aggregated into a large droplet while they flow in such unwanted regions, this prevents a large water droplets from landing on a sheet passing thereunder. Thus, partial non-uniformity of the water content in the sheet is reduced to reduce the occurrence of wrinkles and breakage.

The housing may be provided with a port through which water droplets sprinkled by the sprinkler exit and may include an upper limit edge and a lower limit edge respectively serving as upper and lower ends of the port, and the upper limit edge does not protrude from the vertical plane on which the lower limit edge is located.

As a result, even when water droplets drop from the upper limit edge of the housing serving as the upper end of the port as a result of the action of gravity, the water droplets are received by the lower part of the housing. This reduces the possibility of problems caused by water dropping upon underlying components. The collection of water with the water container makes it possible to achieve an improved collection ratio.

The sheet humidifier may include:

blocking means for opening and closing the slit of the housing; and blocking control means for controlling the timing for blocking the slit with the blocking means based on transport information of the cut sheet transported by the transport means. By opening the slit as needed and closing it when there is no need based on the transport information of the cut sheet as described above, the amount of sprinkled water can be suppressed. This makes it possible to reduce the number of operations to replenish the apparatus with water.

The sheet humidifier may include water amount control means for controlling the amount of water supplied by a water supply device depending on the type of the cut sheet images formed on the cut sheet and the ambient temperature or humidity.

This makes it possible to sprinkle the optimal amount of water on each sheet based on the various parameters.

According to the invention, there is provided an image forming apparatus comprising:

transport means for transporting a cut sheet;

at least a pair of sheet guide portions facing each other for allowing the cut sheet transported by the transport means to pass therebetween in one direction and for exposing front and rear sides of the cut sheet;

a sprinkler provided outside the sheet guide portions for sprinkling water droplets toward one of the sheet guide portions to supply moisture to the cut sheet passing between the sheet guide portions; and an image forming unit for forming an image on the cut sheet.

According to the invention, there is provided a binding system comprising:

an image forming unit for forming an image on a cut sheet by transferring the image thereto and by fusing the transferred image;

humidity adjusting means for supplying moisture to the cut sheet having the image formed by the image forming unit; and binding means for binding a plurality of cut sheets supplied with moisture by the humidity adjusting means.

According to the invention, the humidity adjusting means supplies moisture to cut sheets whose dimensions have shrunk as a result of fusing to recover the sheet dimensions. The binding means binds the plurality of cut sheets whose dimensions have been recovered by the humidity adjusting means. This reduces the possibility of waves and the like on the completed book.

DETAILED DESCRIPTION OF PREFERRED EMBODIMENTS

Various embodiments of the invention will now be described with reference to the drawings.

A. Brief Description of Image Forming Apparatus

Figure 3:
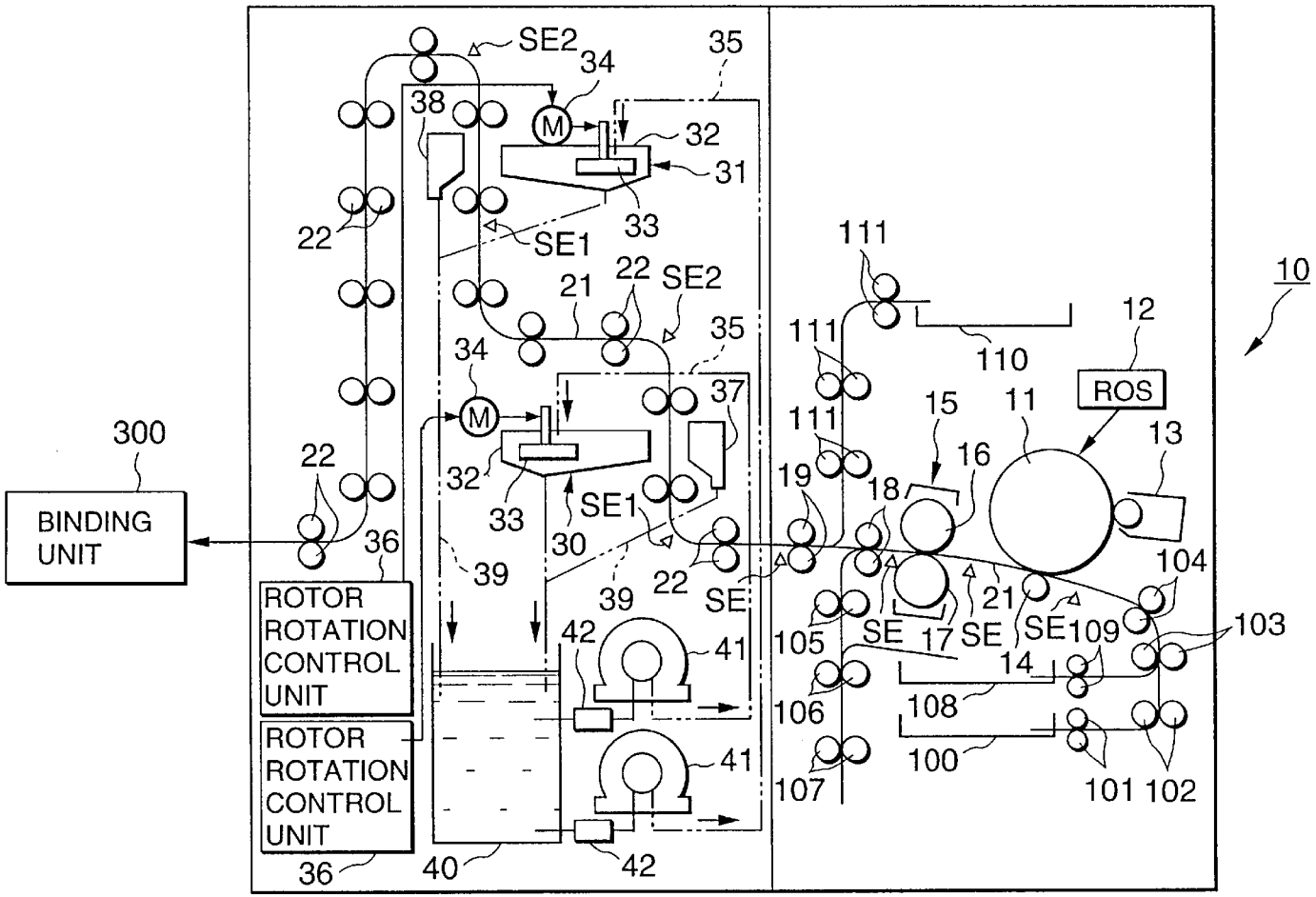
FIG. 3 is a schematic view of an image forming apparatus having an image forming unit and a sheet humidifier unit incorporating the invention.

FIG. 3 is an image forming apparatus incorporating the invention. The image forming apparatus is a copier or printer having an image forming unit 10, a sheet humidifier unit 20 and binding unit 300. Each of those units has an independent cabinet, and components of the units are incorporated in the respective cabinets. The cabinets can be attached to and detached from each other.

The image forming unit 10 has a well known configuration and includes a photosensitive drum 11 rotatable clockwise in FIG. 3, a latent image writing device (ROS) 12, a developer 13 and a transfer roll 14. The latent image writing device 12 forms a latent image by irradiating the surface of the photosensitive drum 11 with laser light based on an image signal. The developer 13 supplies toner to the surface of the photosensitive drum 11 to develop the latent image with the toner. The image formed by the toner applied by the developer 13 on to the surface of the photosensitive drum 11 is absorbed by the transfer roll 14 and is then electrostatically absorbed by a cut sheet of paper that passes through the nip between the transfer roll 14 and the photosensitive drum 11. Cut sheets are contained in a container tray 100 and are transferred by rolls 101 through 104 through the nip. In FIG. 3, the transportation path of cut sheets indicated by the solid line is assigned a reference number 21.

The image forming unit 10 is further equipped with a fuser 15. The illustrated fuser 15 is equipped with a rotating heater roll 16 and a press roll 17 driven by the same for rotation. A cut sheet is passed through the nip between the rolls 16 and 17 to be pressed and heated. This action fuses toner on to the sheet. However, the fuser may be a type including a rotating heater roll and a pad pressed into contact with the same through which sheets are passed or an oven type which does not involve heating.

A sheet having toner fused thereon is transported by transport rolls 18 to transport rolls 19 or inversion rolls 105. The direction of a gate which is not shown determines to which of the transport rolls 19 or inversion rolls 105 the sheet is transported. When an image is to be formed on the side opposite to side on which an image has already been formed, the gate is controlled such that the sheet is transported to the inversion rolls 105. When images have been formed on both sides or when an image is to be formed on one side only, the gate is controlled such that the sheet is transported to the transport rolls 19. The sheet is supplied to the sheet humidifier unit 20 past the transport rolls 19.

A sheet which has been directed toward the inversion roll 105 is transported downward by inversion rolls 106 and 107. Thereafter, the inversion rolls 106 and 107 are reversed to guide the sheet to a stack tray 108 in which the sheet is temporarily stored. The sheet in the stack tray 108 is pulled out by rollers 109 and is passed through the nip between the transfer roll 14 and photosensitive drum 11. During the passage, a toner image is absorbed on to the second side of the sheet and is fused on to the sheet as it passes through the fuser 15. The sheet on which images have been thus formed on both sides thereof is supplied through transport rolls 18 and 19 to the sheet humidifier unit 20.

The image forming unit 1 includes a container tray 110 for containing insert sheets. Insert sheets are sheets having no image formed thereon which are to be inserted between sheets having images formed thereon as described above. A binding unit (not shown) performs binding with the insert sheets inserted between other sheets. While other sheets contained in the container tray 100 are normally in white, the insert sheets are colored paper so that they are distinguishable when bound into a book. The insert sheets are pulled out from the container tray 110 and are transported by transport rolls 111 to be supplied to the sheet humidifier unit 20 through the transport rolls 19. The sheet humidifier unit 20 does not supply moisture to the insert sheets which are simply transported by transport rolls 22 through the sheet humidifier unit 20 to be supplied to the binding unit.

The sheet humidifier unit 20 is equipped with a multiplicity of pairs of transport rolls 22 for transporting sheets in a transport path 21 and two sprinklers 30 and 31. The sprinklers 30 and 31 sprinkle water droplets on both sides of sheets as the sheets are transported by the transport rolls 22. Each of the sprinklers 30 and 31 has a housing 32 and a rotor 33 which is provided and rotated in the housing 32. The rotor 33 is driven by a motor 34 for rotation about a vertical shaft. Each of the motors 34 is driven and stopped in accordance with commands from a rotor rotation control unit 36. The configuration of the rotor 33 will be detailed later.

Water is dropped on the rotors 33 from supply pipes 35 indicated by two-dot chain lines. The water is splashed substantially horizontally by the centrifugal force of the rotating rotor 33 in the form of droplets. The housing 32 of the sprinkler 30 provided on the left side of the transport path 21 is formed with a port facing right through which water droplets are sprinkled to hit upon cut sheets. The housing 32 of the sprinkler 31 provided on the right side of the transport path 21 is formed with a port facing left through which water droplets are sprinkled to hit upon cut sheets.

Figure 4:
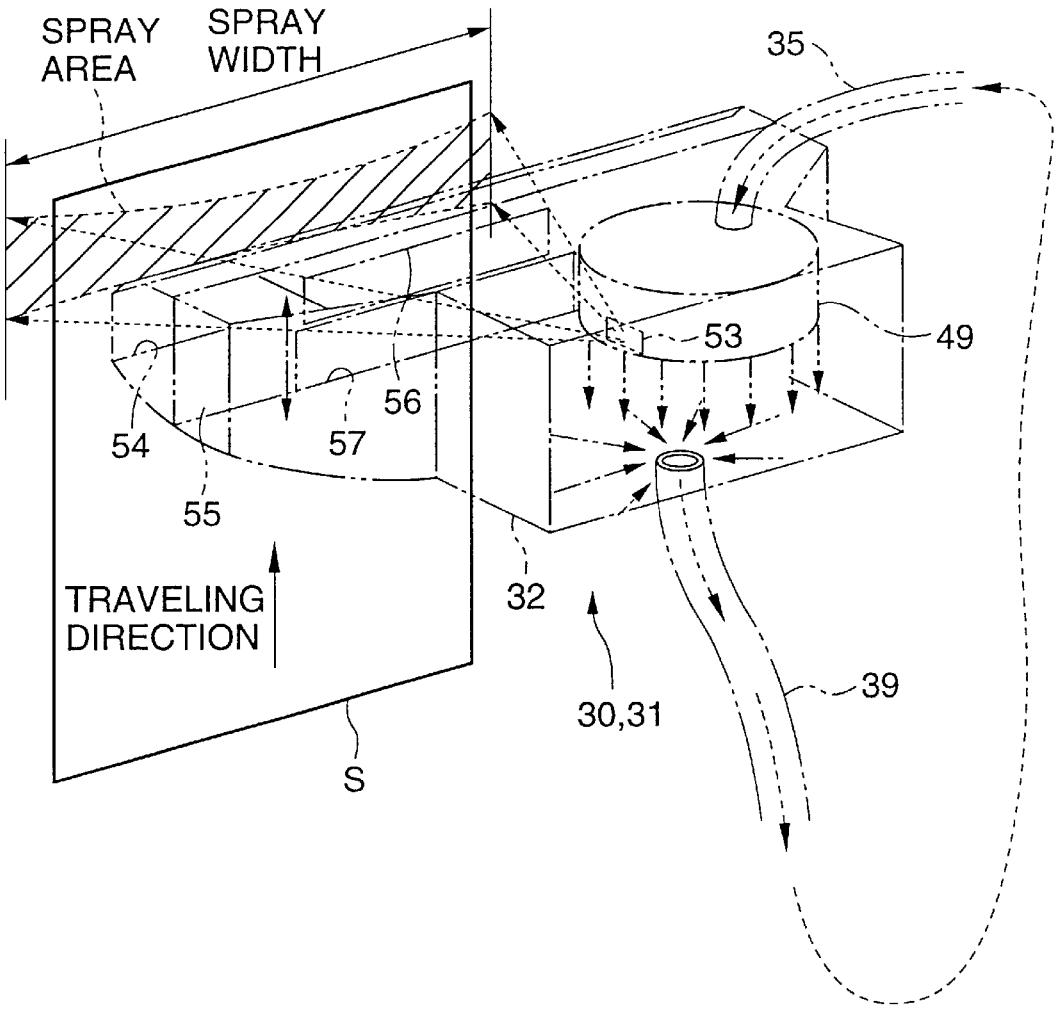
FIG. 4 is a schematic perspective view of a sprinkler of the image forming apparatus shown in FIG. 3.
Figure 12:
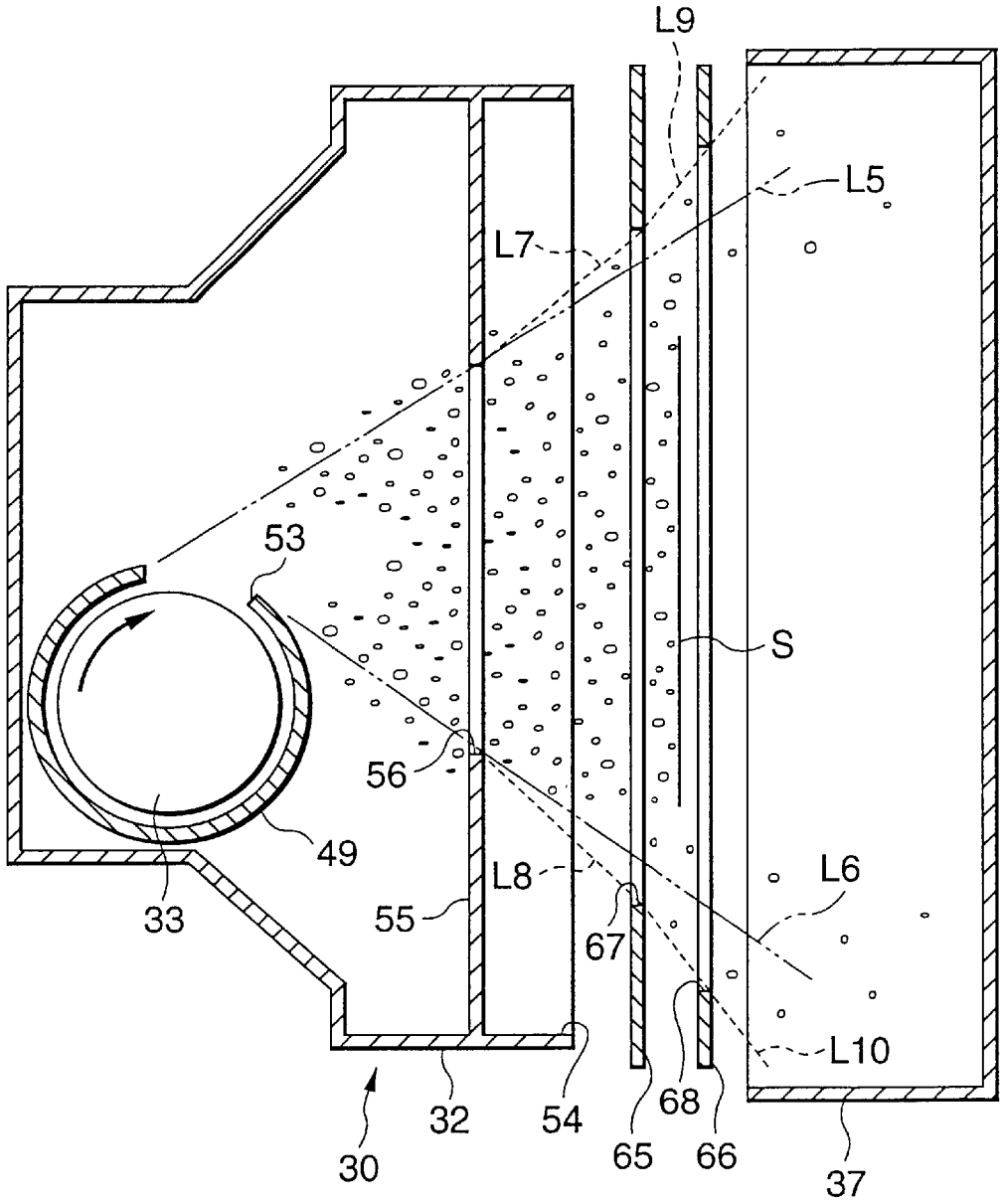
FIG. 12 is a plan view in section showing the sprinkler and the neighborhood thereof.

Water containers 37 and 38 are provided in positions in a face-to-face relationship with the ports on the sprinklers 30 and 31, respectively. The water containers 37 and 38 open toward the ports of the respective sprinklers 30 and 31. Water droplets sprinkled by the sprinkler 30 or 31 are received by the container 37 or 38 when they do not hit upon sheets passing through the transport path 21. For example, since the sprinklers 30 and 31 are designed such that the width of their spray areas is greater than the width of largest cut sheets S as shown in FIGS. 4 and 12, water droplets fly outside a sheet S. Those water droplets are received by the container 37 or 38. When water droplets are sprinkled without interruption during a time interval between the passage of a cut sheet S in the vicinity of the sprinkler 30 or 31 and the passage of the next cut sheet S, the sprinkled water droplets are received by the container 37 or 38.

Referring to FIG. 3 again, discharge pipes 39 indicated by two-dot chain lines are connected to the bottom of the containers 37 and 38, and water contained in the containers 37 and 38 is collected in a tank 40 through the discharge pipes 39 as a result of the action of gravity. A discharge pipe 39 is also connected to the bottom of each of the sprinklers 30 and 31 to collect the portion of the supplied water which has not been sprinkled through the port, into the tank 40 via the discharge pipe 39 by the action of gravity.

The tank 40 is supplied with water by a user. The water in the tank 40 is supplied by a pump 41 to each supply pipe 35 to be circulated. A filter 42 is provided between the inlet of each pump 41 and the tank 40 to prevent particles of paper and contaminants mixed in collected water from entering the supply pipes 35.

In such a configuration, a cut sheet heated by the fuser 15 to be dehumidified first travels in the vicinity of the sprinkler 30 to be humidified by the sprinkler 30 on one side thereof. The cut sheet then travels in the vicinity of the sprinkler 31 to be humidified by the sprinkler 31 on the other side. Cut sheets whose dimensions have been recovered as a result of such forced absorption of humidity are transported to a binding unit (binding means) 300 to be bound into a book. The binding unit 300 will be described later.

B. Configurations of Sprinklers and Water Containers

Figure 5:
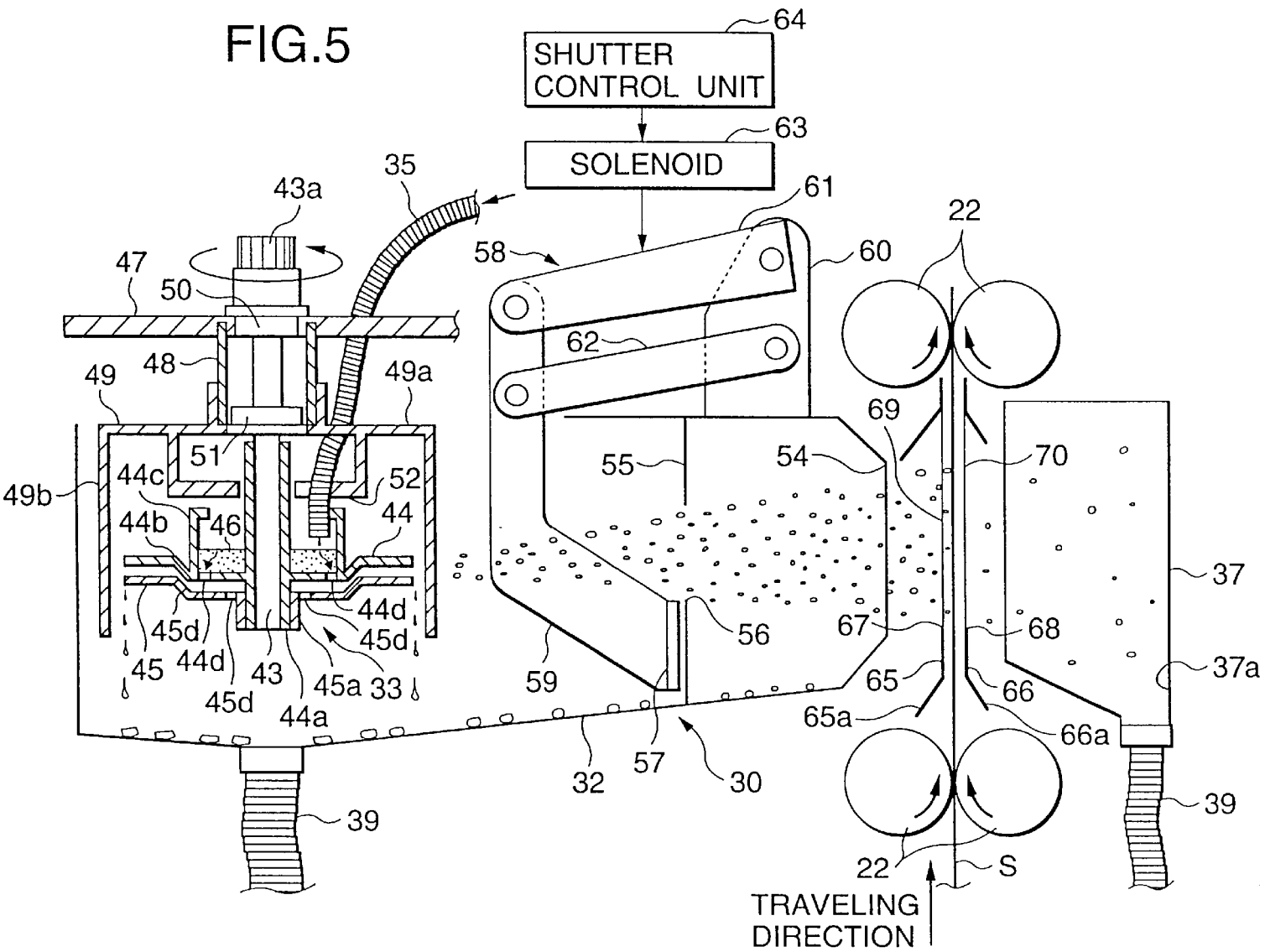
FIG. 5 is a side sectional view showing the sprinkler in operation and neighborhood of the same.

The sprinklers 30 and 31 and water containers 37 and 38 of the sheet humidifier unit 20 will now be described in detail. FIG. 5 is a sectional view showing the sprinkler 30, container 37 and neighborhood thereof. Description will be omitted for the sprinkler 31, container 38 and neighborhood thereof because they are completely the same except that they are in positions which are the reverse of their counterparts.

As shown in FIG. 5, the rotor 33 has a vertical shaft 43 and two discs 44 and 45 secured to the shaft 43. A toothed pulley 43*a* is provided on top of the shaft 43, and a driving force from the motor 34 (see FIG. 3) is transmitted to the toothed pulley 43*a* by a timing belt (not shown) to rotate the shaft 43. The power transmission mechanism is not limited to the timing belt mechanism and may be other pulley mechanisms or wheel train mechanisms. The shaft 43 may be directly coupled to the motor shaft.

The upper disc 44 includes a cylindrical portion 44*a* in the middle thereof which surrounds the shaft 43 and which is secured to the same, a disc portion 44*b* protruding outward from the cylindrical portion 44*a* and a cylindrical wall 44*c* protruding above the disc portion 44*b*. The lower disc 45 includes a cylindrical portion 45*a* in the middle thereof which surrounds the cylindrical portion 44*a* of the disc 44 and which is secured to the same and a disc portion 45*b* protruding outward from the cylindrical portion 45*a*.

As shown in FIG. 5, the disc portions 44*b* and 45*b* have curved sections and are uniformly spaced from each other in the radial direction. The gap defined in the circumferential direction serves as a water flow channel. The end of the supply pipe 35 is disposed in the cylindrical wall 44*c* into which water flows. The upper disc portion 44*b* is formed with a plurality of through holes 44*d* through which the water in the cylindrical wall 44*c* drops or flows downward into the channel between the disc portions 44*b* and 45*b*, and the water is splashed outward in the form of water droplets by a centrifugal force during rotation. The through holes 44*d* are located in the vicinity of the cylindrical wall 44*c* (i.e., in the outermost positions where water can flow downward from the cylindrical wall 44*c*), and the water in the cylindrical wall 44*c* can thus pass through the through holes 44*d* even under the centrifugal force. A member having water absorption properties, e.g., a sponge 46, is disposed in the cylindrical wall 44*c*. The sponge 46 allows water to be distributed throughout the interior of the cylindrical wall 44*c* and consequently causes water droplets to be uniformly sprinkled upon the entire rotor 33 in the circumferential direction thereof. The sponge 46 may be replaced with layered cloth or unwoven fabric.

Figure 6:
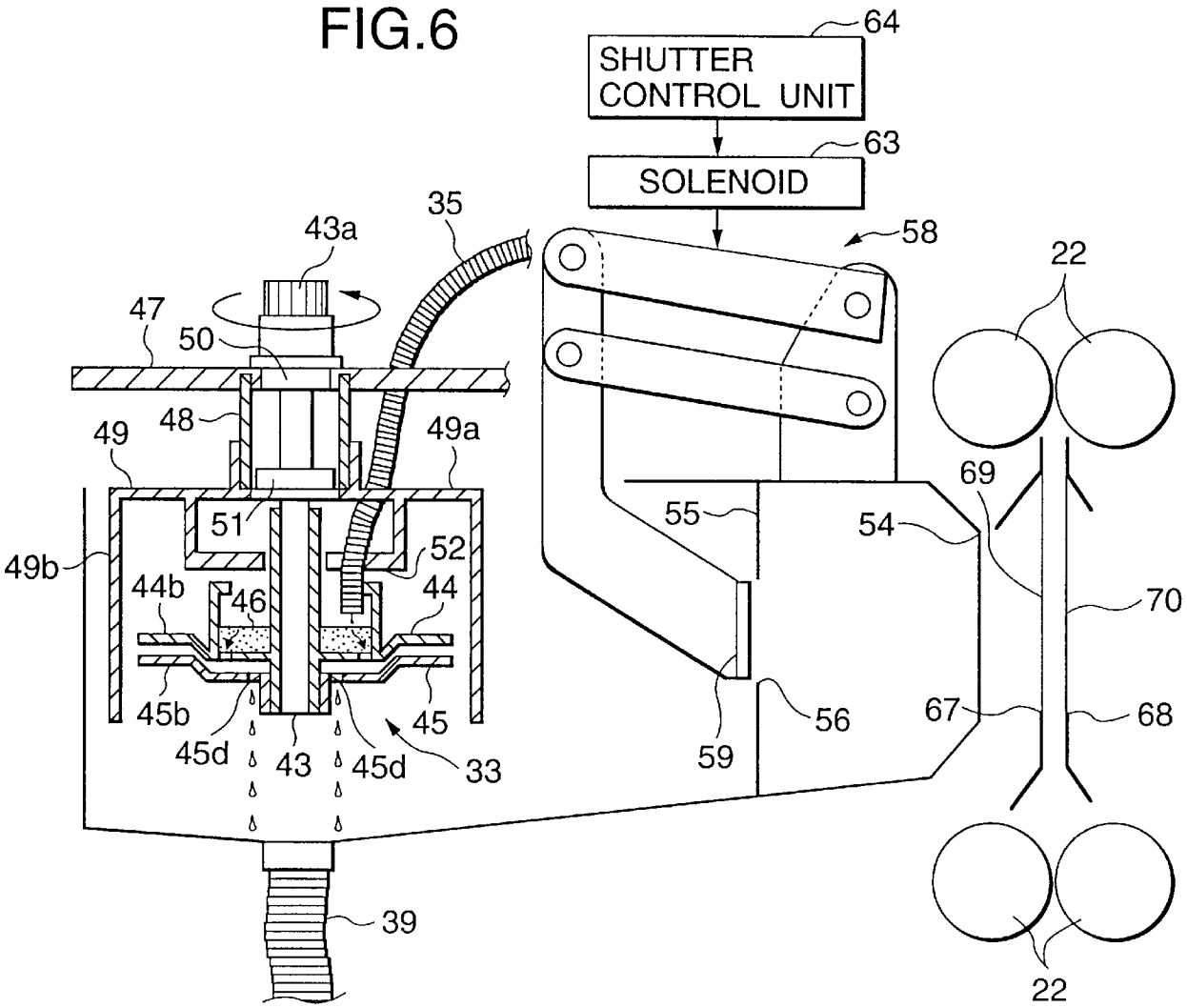
FIG. 6 is a view similar to FIG. 5 showing the sprinkler with the rotor stopped.

The lower disc portion 45*b* is also formed with a plurality of through holes 45*d*. The through holes 45*d* are located in the vicinity of the cylindrical portion 45*a* (i.e., in the innermost positions where water can flow downward from the channel). Therefore, while only a small amount of water in the channel passes through the through holes 45*d* when there is a centrifugal force produced by rotation, water flows downward through the through holes 45*d* when the rotation is stopped (see FIG. 6).

A horizontal support plate 47 for supporting the rotor 33 is provided above the housing 32. A bearing 50 is attached to the support plate 47. A hollow cylinder 48 is suspended by and secured to the support plate 47, and an inner case 49 is suspended by and secured to the hollow cylinder 48. The inner case 49 has a round upper wall 49*a* and a cylindrical side wall 49*b* which surround the discs 44 and 45 of the rotor 33. A bearing 51 is attached to the upper wall 49*a* in the middle thereof. The shaft 43 of the rotor 33 is rotatably supported by the bearings 50 and 51 and extends through the hollow cylinder 48 and inner case 49. The end of the supply pipe 35 is secured to the upper wall 49*a* from which a fixed wall 52 is suspended to cause water to flow into the cylindrical wall 44*c*. Each of the support plate 47, upper wall 49*a* and fixed wall 52 is formed with a through hole (not shown) through which the supply pipe 35 is passed.

While the discs 44 and 45 of the rotor 33 are surrounded by the inner case 49, as shown in FIG. 4, the side wall 49*b* is formed with a slit 53 only in one location. Therefore, water droplets radially sprinkled as a result of the rotation of the rotor 33 can fly out only through the slit 53. Other droplets hit the inner circumferential surface of the side wall 49*b* to flow downward.

The housing 32 is formed with a port slit 54 through which water droplets are ejected on the side thereof at which water is sprinkled. An intermediate partition wall 55 is provided between the port slit 54 and inner case 49, and the intermediate partition wall 55 is formed with an intermediate slit 56. Water droplets ejected through the slit 53 on the inner case 49 can exit the housing 32 through the intermediate slit 56 and port slit 54 to land on the cut sheets S transported by the transport rolls 22. As shown in FIG. 4, the spray area of the sprinkler 30 is in the form of a rectangular which is determined by the configuration of the intermediate slit 56, and the spray width is greater than the width of the largest cut sheets S.

Figure 7:
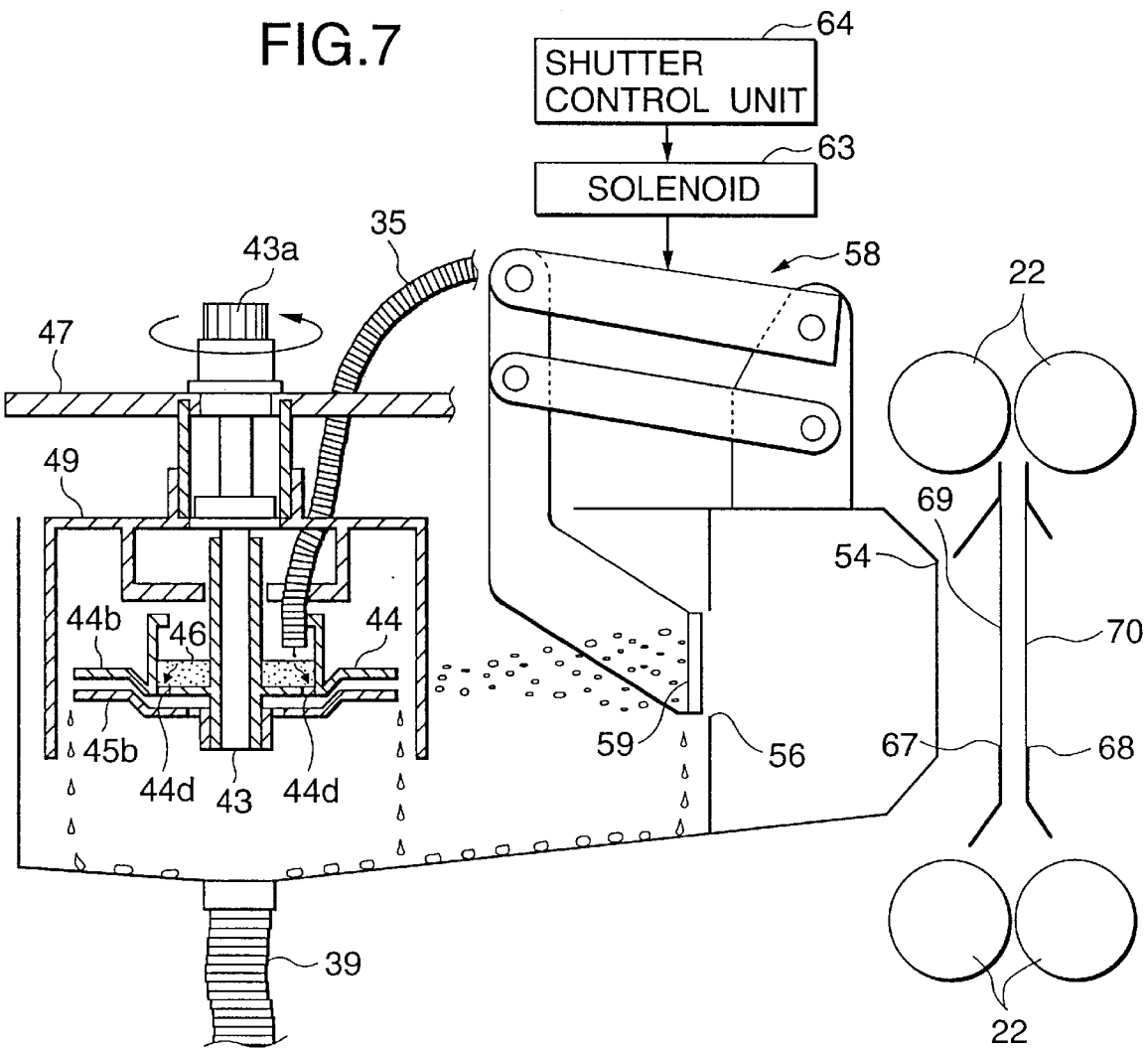
FIG. 7 is a view similar to FIG. 5 showing a state of the sprinkler in which sprinkling is blocked with a shutter.

Referring again to FIG. 5, the intermediate slit 56 can be opened and closed by a shutter 57. The shutter 57 is attached to an arm 59 which is a part of a parallel crank mechanism 58. The parallel crank mechanism 58 includes a support body 60 attached to the top plate of the housing 32, the arm 59 in parallel with the support body 60 and links 61 and 62 coupled to them with pins. The link 61 is driven by a solenoid 63 for swinging to elevate or lower the shutter 57. The solenoid 63 is controlled by a shutter control unit 64. As shown in FIG. 7, when the shutter 57 closes the intermediate slit 56, water droplets ejected from the inner case 49 as a result of the rotation of the rotor 33 are blocked by the shutter and do not reach the port slit 54.

Water which has not been ejected from the port slit 54 drops to the bottom wall of the housing 32. The bottom wall is inclined such that the region directly above the discharge pipe 39 in the vertical direction becomes lowest, which makes it easy to discharge the water that has dropped on the bottom wall. Although not shown, one or a plurality of through holes are provided in a lower part of the intermediate partition wall 55 to allow water to flow from the port slit 54 to the discharge pipe 39. The bottom wall of the water container 37 is also inclined such that the region directly above the discharge pipe 39 in the vertical direction becomes lowest, which makes it easy to discharge water that has dropped on the bottom wall.

C. Guidance of Cut Sheet

A description will now be made on features provided on a guide member for humidifying cut sheets efficiently. As shown in FIG. 5, a pair of guide plates 65 and 66 facing each other are provided between a pair of transport rolls 22 and the next pair of transport rolls 22, and the cut sheets S travels upward between the guide plates 65 and 66. Lower ends 65*a* and 66*a* of the guide plates 65 and 66 (the ends located upstream as viewed in the traveling direction of the cut sheets S) are bent such that the interval between them increases with the decreasing elevation, which allows the end of a cut sheet S to enter the gap between the guide plates 65 and 66 easily.

Figure 8:
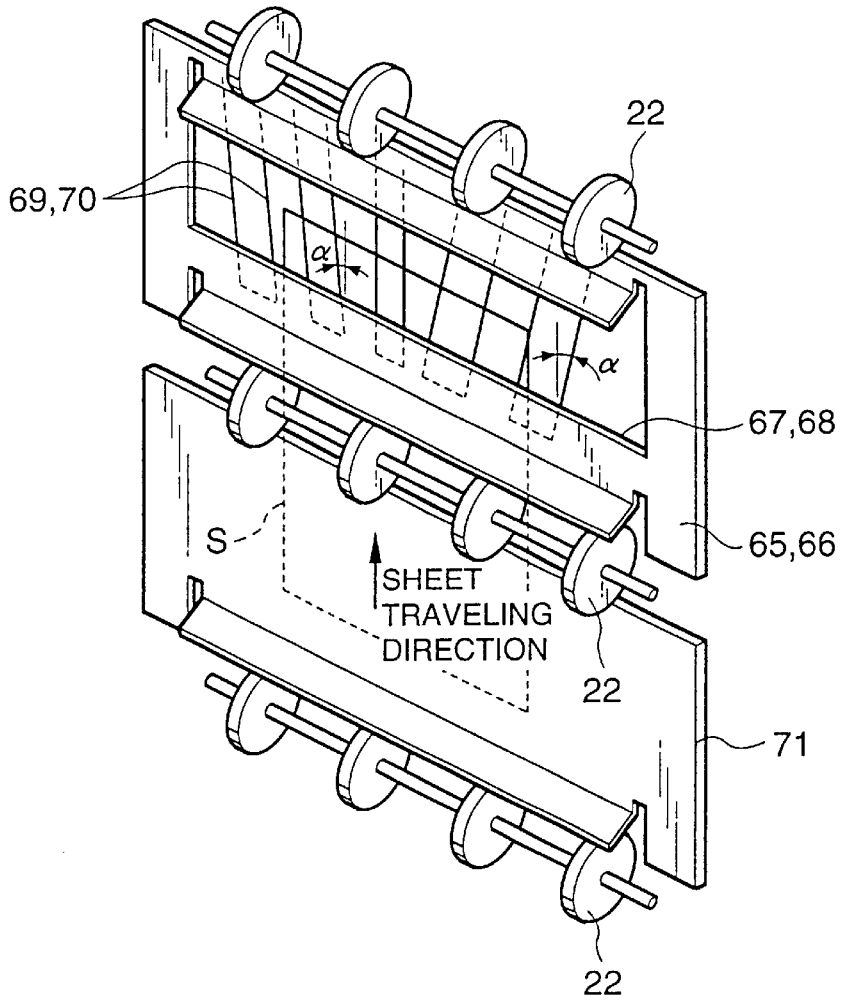
FIG. 8 is a perspective view of one of guide plates used in the sprinkler.

Paired guide plates for the same purpose are provided in regions between transport rolls 22 to apply a transporting force to the cut sheets S. FIG. 8 shows one of such guide plates (guide plate 71). Rectangular openings 67 and 68 are respectively formed on the guide plates 65 and 66 to supply water droplets to the sheets S. Water droplets from the sprinkler 30 pass through the opening 67 of the guide plate 65 closer to the sprinkler 30 to hit the cut sheets S. For the reason described above, water droplets which have not hit the sheets pass through the opening 68 of the guide plate 66 farther from the sprinkler 30 to be received by the container 37.

Although the openings 67 and 68 are provided to allow water droplets to pass, a plurality of linear bodies 69 are vertically stretched across the opening 67 with some tension in order to guide the cut sheets S reliably. A plurality of linear bodies 70 are also stretched across the opening 68 in the same manner. The linear bodies 69 and 70 are preferably resistant to corrosion and oxidation. For example, they may be lines made of aromatic polyamide or polytetrafluoroethylene, or wires made of stainless steel or wires coated with polytetrafluoroethylone on the periphery thereof. The linear bodies 69 and 70 are secured to the respective guide plates 65 and 66 by means of, for example, welding or bonding.

The diameter of the linear bodies 69 and 70 is preferably smaller than the diameter of normal droplets sprinkled by the sprinkler 30 to reach the cut sheets S. For example, the diameter of the linear bodies 69 and 70 is preferably less than 1 mm and more preferably less than 0.2 mm when the diameter of normal droplets is 1 mm. By making the linear bodies 69 and 70 thinner as described above, the area on a cut sheet S wetted by water can be increased.

As shown in FIG. 8, some of the linear bodies 69 and 70, especially outer ones are at an angle to the vertical, i.e., to the traveling direction of the cut sheets S so that the intervals between the linear bodies generally increase with the distance traveled by the cut sheets S downstream. The angle $\alpha$ of the inclination is about 5°. Advantageous effects of this configuration will be described below.

Figure 9A:
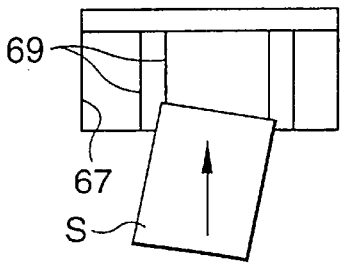
FIGS. 9A, 9B and 9B schematically illustrate the travel of a sheet with linear bodies provided on the guide plate improperly.
Figure 9B:
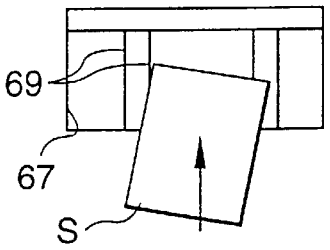
Figure 9C:
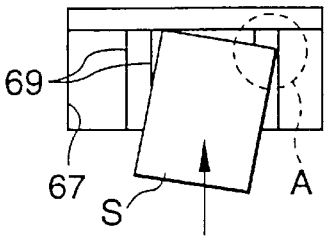

FIGS. 9A, 9B and 9C illustrate the travel of the cut sheets S in a configuration different from the present embodiment in which all of the linear bodies 69 are arranged in parallel with the traveling direction of the sheets S. FIGS. 9(A), 9(B) and 9(C) illustrate different states that sequentially occur. While no problem occurs when a sheet S is passed without skew, the sheet S can be jammed or bent when it is skewed as illustrated because either of the upper corners of the sheet slip under any of the linear bodies 69 to be caught by the same as the sheet travels as represented in the region A.

Figure 10A:
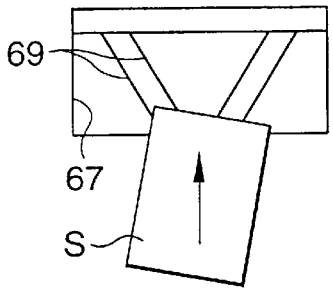
FIGS. 10A, 10B and 10C schematically illustrate the travel of a sheet with linear bodies provided on the guide plate properly.
Figure 10B:
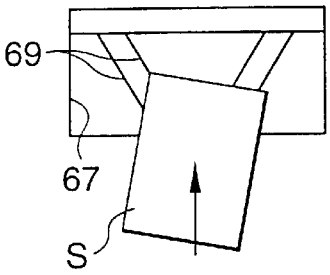
Figure 10C:
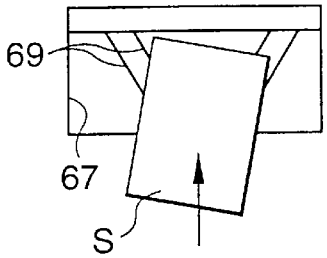

FIGS. 10A, 10B and 10C illustrate the travel of a sheet S in the configuration of the linear bodies 69 according to the present embodiment. The angle of inclination of the linear bodies 69 is exaggerated. In this case, even if the sheet S is skewed, the upper corners of the sheet S will not be caught by the linear bodies 69 and the possibility of jamming or bending is thus reduced. Since the linear bodies 69 are at an angle to the traveling direction of the sheet S, regions of the sheet S which have been blocked by the linear bodies 69 from water droplets are exposed to water droplets as the sheet S proceeds. Thus the humidified area can be increased.

While one guide plate 65 or 66 is formed with one opening 67 or 68 in the illustrated embodiment, it is not intended to limit the invention to such a configuration. Alternatively, two guide plates may be spaced from each other in the traveling direction of a sheet S, and linear bodies may be stretched across the gap (opening) between them.

D. The Details of the Configurations of Housing and Guide Plates

Figure 11:
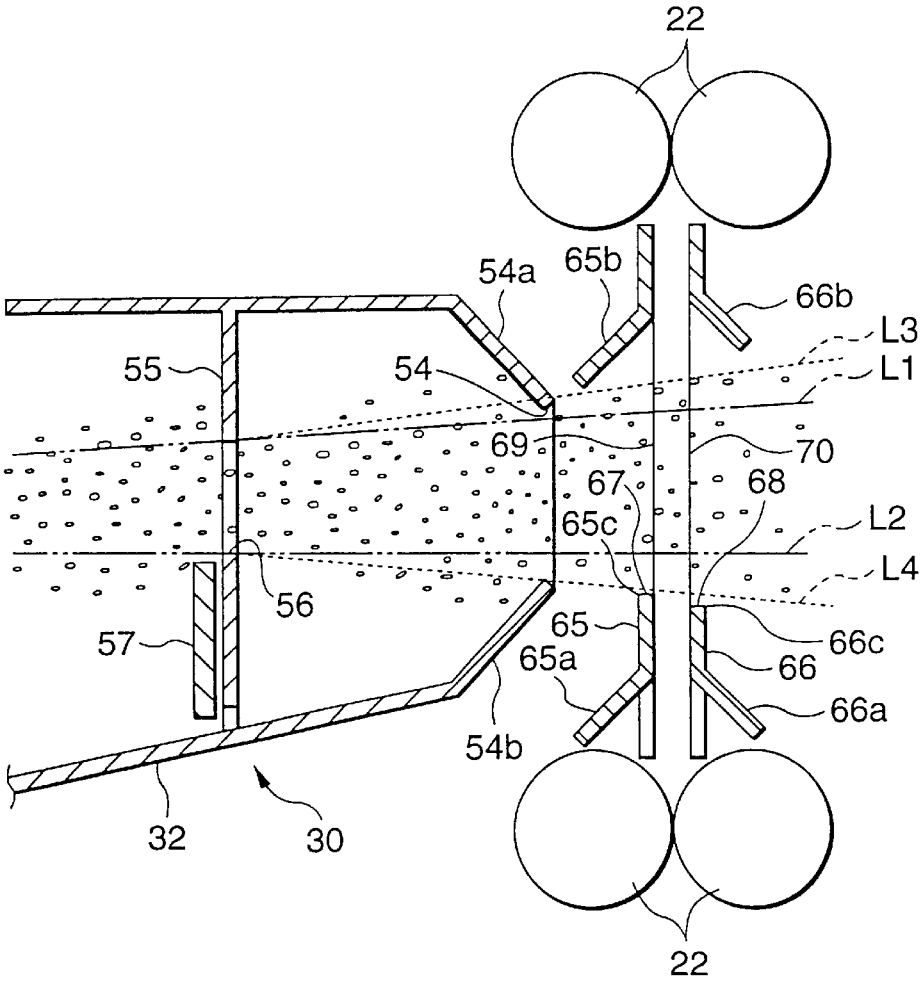
FIG. 11 is a side view in section showing the housing and the pair of guide plates of the sprinkler in detail.

The configurations of the housing 32 of the sprinkler 30 and the guide plates 65 and 66 will now be described in detail. FIG. 11 is an enlarged view of the intermediate slit 56 and port slit 54 of the housing 32 and the guide plates 65 and 66. As shown in FIG. 11, taper portions 54*a* and 54*b* are provided at the end portion of the housing 32 at an interval that becomes smaller with the distance to the ends thereof. The taper portions 54*a* and 54*b* serve as lips that define the port slit 54. That is, the taper portions 54*a* and 54*b* respectively include an upper limit edge and a lower limit edge of the port slit 54. The taper portions 54*a* and 54*b* taper the space inside the housing 32 to narrow it to the minimum at the port slit 54.

As described above, water droplets sprinkled by the sprinkler 30 can reach the opening 67 of the guide plate 65 if they pass through the intermediate slit 56 of the intermediate partition wall 55 and the port slit 54. In other words, the housing 32 is formed with slits 56 and 54 which are smaller than the opening 67 and through which water droplets sprinkled by the sprinkler 30 pass in order to limit the range of the water droplets sprinkled by the sprinkler 30. Specifically, the intermediate slit 56 limits the water droplets substantially to the range between upper and lower limit lines L1 and L2 indicated by two-dot chain lines in FIG. 11. Since some droplets are reflected by the lips that define the intermediate slip 56, there is a small number of droplets that fly outside the range.

However, the port slit 54 of the housing 32 further limits the water droplets substantially to the range between upper and lower limit lines L3 and L4 indicated by broken lines. The openings 67 and 68 of the guide plates 65 and 66 are designed such that their upper and lower edges are not located between the upper and lower lines L3 and L4. Specifically, an upper edge 66*b* of the opening 68 of the guide plate 66 is located higher than an upper edge 65*b* of the opening 67 of the guide plate 65 and a lower edge 66*c* of the opening 68 is located lower than a lower edge 65*c* of the opening 67 so that they do not come into the range of water droplet that radially spreads. Thus, the guide plates 65 and 66 are prevented from getting wet in regions other than the openings 67 and 68 as much as possible.

FIG. 12 is a plan view in section of the sprinkler 30 and container 37. As shown in FIG. 12, the intermediate slit 56 limits the flying range of water droplets substantially to the range between lines L5 and L6 in the horizontal plane. However, since some droplets are reflected by the lips that define the intermediate slip 56, there is a small number of droplets that fly outside the range. The range of such water droplets is between lines L7 and L8. The port slit 54 is considerably greater than such a maximum flying range of water droplets (the range between the lines L7 and L8). Therefore, the range of water droplets is limited only by the intermediate slit 56 in the horizontal plane.

The opening 67 of the guide plate 65 closer to the sprinkler 30 is wider than the range between the line L5 and L6 in the horizontal plane. This minimizes the exposure of regions of the guide plate 65 other than the opening 67 to water. The openings 67 and 68 of the other guide plate 66 are wider than the opening 68 in the horizontal plane. Therefore, even if water droplets fly along the trajectories indicated by the lines L7 and L8 and are reflected by the edges of the opening 67 to fly along the trajectories indicated by the lines L9 and L10, regions of the guide plate 66 other than the opening 68 are kept unwetted.

Figure 13:
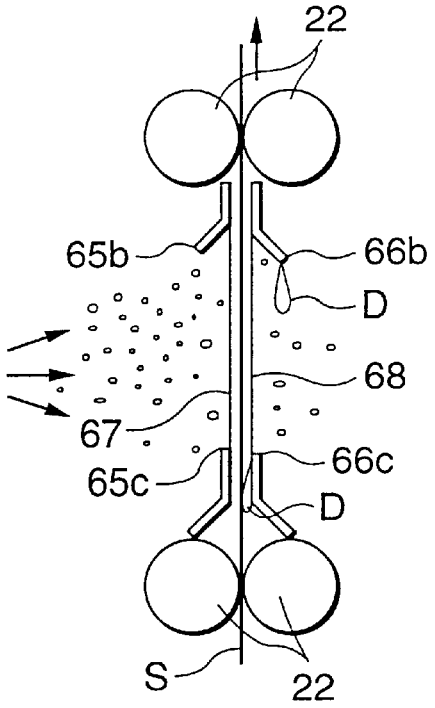
FIG. 13 is a schematic view showing an improper arrangement of the guide plate.

FIG. 13 illustrates a case wherein upper and lower edges 66*b* and 66*c* of the opening 68 of the guide plate 66 get wet unlike the present embodiment. A water droplet D which has hit the upper edge 66*b* drops upon the transport roll 22 located directly under the same and transfers from the roll 22 to the sheet S. A water droplet D which has hit the lower edge 66*c* transfers from the edge 66*c* directly to the sheet S. When the volume of the droplets is excessive, problems such as partial wrinkles and breakage of the sheet S can occur as described above. In the present embodiment, however, the guide plate 66 is protected from water to prevent such problems.

Figure 14:
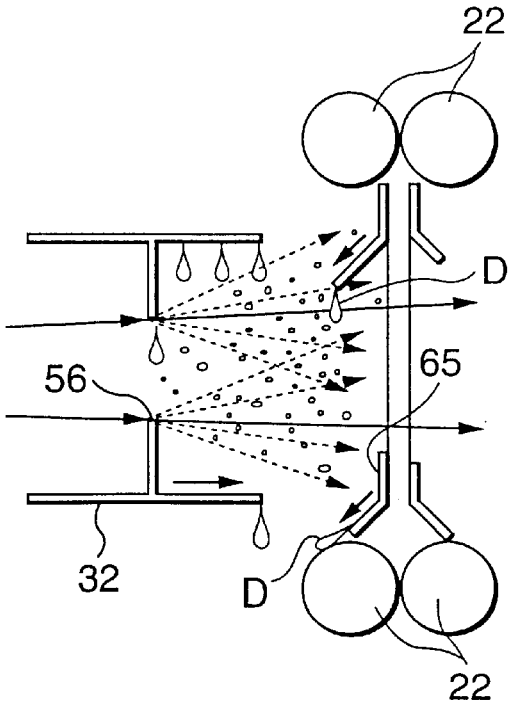
FIG. 14 is a schematic view showing an improper configuration of the housing.

FIG. 14 shows a sprinkler in which the upper and lower walls of the housing 32 to define the port are parallel and in which the port slit 54 is not provided unlike the present embodiment. In the sprinkler shown in FIG. 14, a water droplet D reflected at the intermediate slit 56 can reach regions of the guide plate 65 other than the opening 67 without being limited. Therefore, the water can further drop upon underlying components to cause problems in them. Further, a great amount of water can stay on the transport roller 22 directly under the guide plate 65 to supply an excessive amount of water to a sheet S in contact with the roll instantaneously and partially. While there is no problem if only a small amount of water is supplied by the transport roller 22, wrinkles or breakage can occur if the amount of water is great.

However, as shown in FIG. 11, such a problem can be avoided by the port slit 54 provided downstream which narrows the range of water droplets further in the vertical direction in the present embodiment. However, this is not limiting the present invention, and only one slit may be sufficient depending on conditions such as the spraying speed of water droplets and the amount of supplied water.

Figure 15:
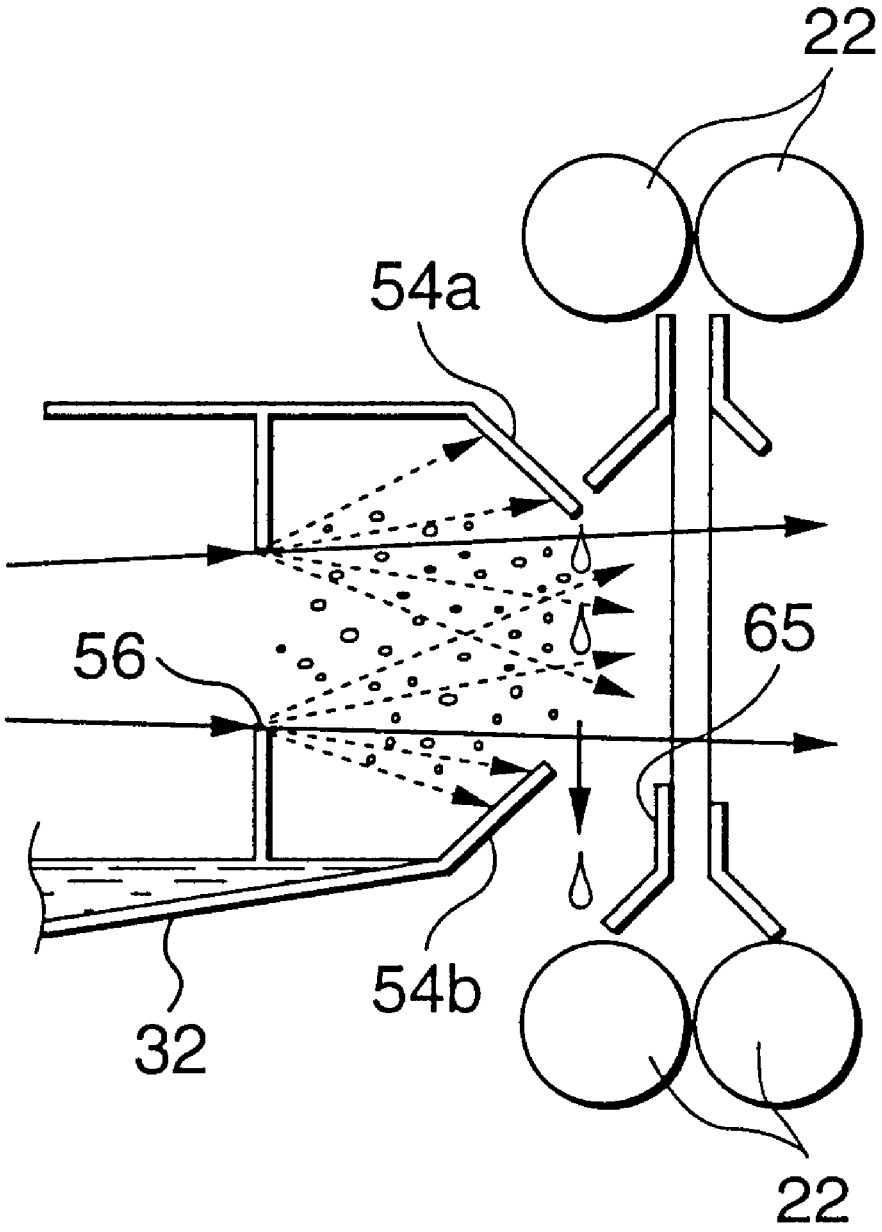
FIG. 15 is a schematic view showing another improper configuration of the housing.

As shown in FIG. 11, the upper limit edge of at the end of the upper taper portion 54*a* is located on the vertical plane on which the lower limit edge at the end of the lower taper portion 54*b* is located. FIG. 15 shows a sprinkler in which the upper taper portion 54*a* protrudes from the vertical plane on which the lower limit edge at the end of the lower taper portion 54*b* is located unlike the present embodiment. In the sprinkler shown in FIG. 15, a water droplet which has hit the inner surface of the upper taper portion 54*a* flows down the surface to drop upon the transport roll 22 directly under the guide plate 65.

Therefore, a great amount of water can be instantaneously and partially supplied to a sheet S in contact with roller to cause wrinkles or breakage on the same.

In the present embodiment shown in FIG. 11 having the above-described arrangement of the upper limit edge at the end of the upper taper portion 54*a* and the lower limit edge at the end of the lower taper portion 54*b*, any water droplet that drops after hitting the inner surface of the upper taper portion 54*a* is received by the lower taper portion 54*b*. Therefore, the problem encountered in the device shown in FIG. 15 does not occur. As an alternative, the lower taper portion 54*b* may protrude from the vertical plane on which the upper limit edge at the end of the upper taper portion 54*a* is located.

Further, as shown in FIG. 11, the edges 65*b* and 66*b* of the guide plates 65 and 66 directly above the openings 67 and 68 are bent so that they are spaced from each other at an interval that increases as they extend downward. This makes it possible to guide the end of a cut sheet S properly to prevent the jam of the sheet. While the linear bodies 69 and 70 for guiding the cut sheets S are provided across the openings 67 and 68 as described above, a corner of a sheet S passing through the openings 67 and 68 is likely to come out of the guide plate 65 or 66 if the corner is curled. The edges 65*b* and 66*b* are bent as illustrated to return such a corner of a sheet which has once come out to the space between the guide plates 65 and 66, thereby preventing the sheets from jamming.

The edges 65*b* and 66*b* bent as shown in FIG. 11 reduces the possibility of a large water droplet dropping directly upon a sheet S even when water droplets fly above the upper limit line L3 determined by the port slit 54 to land on the guide plates 65 and 66 in positions higher than the openings 67 and 68 as a result of fluctuation of the speed of water droplets and the like. Therefore, as shown in FIG. 16, a modification is possible in which the taper portion 54*a* above the port slit 54 is not provided.

The lower end of the edge 65*b* toward the sprinkler 30 which is bent as described above must not be located directly above the opening 67 in the vertical direction. The reason will be described with reference to FIGS. 16, 17A, 17B and 17C.

Figure 16:
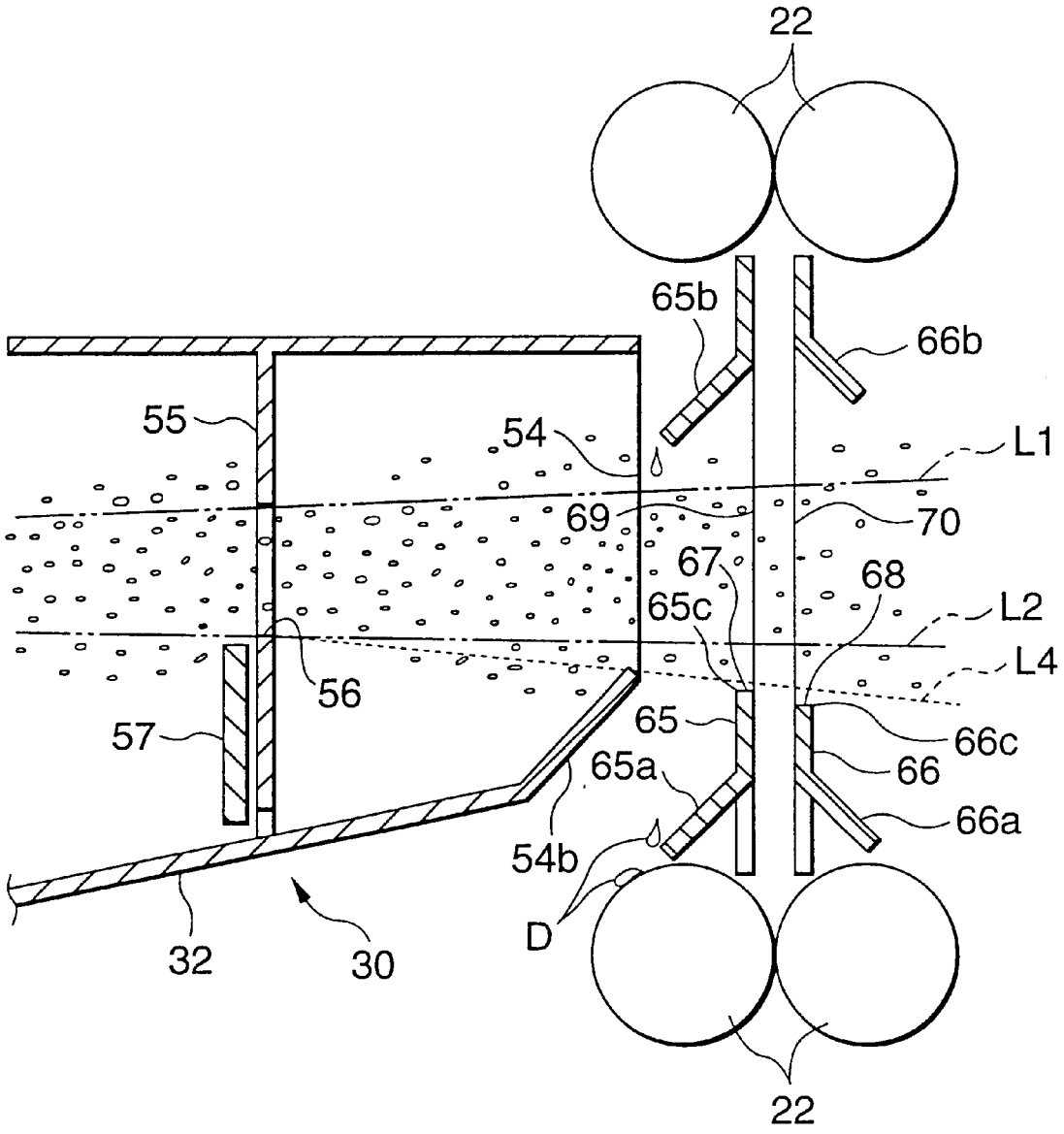
FIG. 16 is a detailed side view in section of a housing and a pair of guide plates of a sprinkler which is a modification of the invention.

As shown in FIG. 16, when water droplets fly above the upper limit line L3, they can hit the edge 65*b* bent to protrude toward the sprinkler 30. Such water droplets D drop upon the transport roll 22 directly under the guide plate 65 as a result of the action of gravity. Therefore, an excessive amount of water is supplied to a sheet S in contact with the roll, which can cause wrinkles and breakage of the same. While such dropping water is undesirable, the dropping water can be collected without adversely affecting the roll and sheet by providing a roll cover over the transport roll and providing a water-receiving member for collecting water which has dropped upon the roll cover.

Figure 17A:
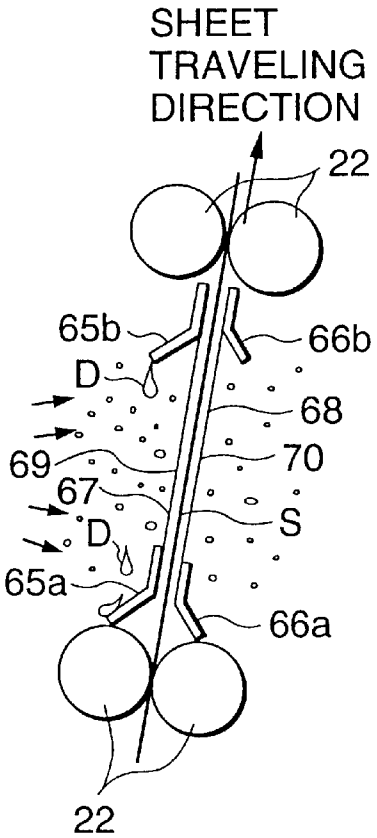
FIG. 17A is a schematic view showing an allowable arrangement of the guide plates.
Figure 17B:
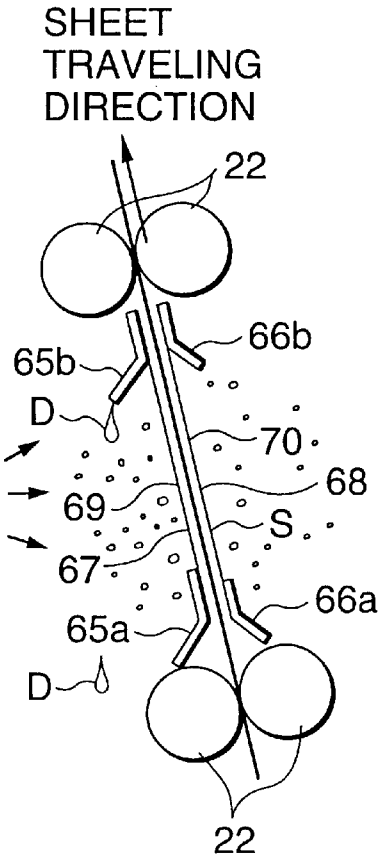
FIG. 17B is a schematic view showing another allowable arrangement of the guide plates.

Even when the transport path of the sheets S is inclined as shown in FIG. 17A, it is not so problematic if the lower end of the edge 65*b* is not directly above the opening 67 and any resultant problem can be solved by the roll cover and water-receiving member. Even when the transport path of the sheets S is inclined as shown in FIG. 17B in the direction opposite to that shown in FIG. 17A, it is not so problematic if the lower end of the edge 65*b* is not directly above the opening 67 and any resultant problem can be solved by the roll cover and water-receiving member.

Figure 17C:
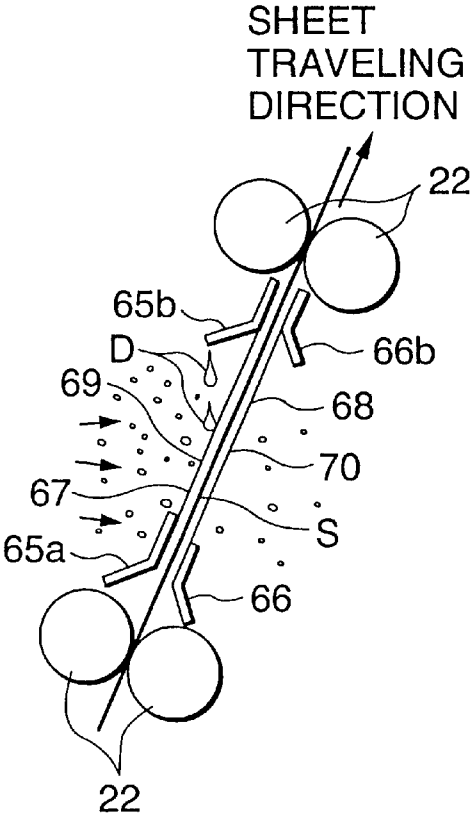
FIG. 17C is a schematic view showing an unallowable arrangement of the guide plates.

However, when the lower end of the edge 65*b* is located directly above the opening 67 as shown in FIG. 17C, a significant problem can occur. Specifically, since a water droplet D directly drops upon a traveling sheet S in this case, a great amount of water is undesirably applied to a part of the same, which can cause wrinkles and breakage with very high probability.

E. Sheet Traveling Direction

As apparent from FIGS. 3 and 5, according to the present embodiment, water droplets are sprinkled by the sprinkler 30 on a cut sheet S while the sheet S is traveling upward. The reason is as follows.

Figure 17D:
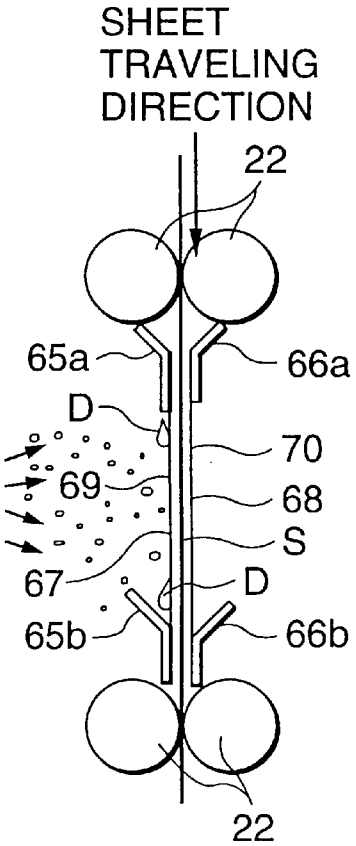
FIG. 17D is a schematic view showing the neighborhood of the guide plates during transportation of a sheet in an improper direction.

FIG. 17D shows an apparatus in which water droplets are sprinkled by the sprinkler 30 on a cut sheet S while the sheet S is traveling downward as opposed to the present embodiment. In this case, in order to guide sheet S traveling downward, the upper ends of the guide plates 65 and 66 are formed to spread with an interval that increases as they extend upward. Therefore, if water droplets hit regions of the guide plate 65 above the opening 67, substantially all of such droplets flow down along the linear bodies 69. Thus, when a sheet S contacts a resultant water droplet, a great amount of water abruptly penetrates through the sheet S instantaneously and partially. This makes the distribution of the water content in the sheet S uneven to increase the possibility of the occurrence of wrinkles and breakage significantly.

On the contrary, according to the present embodiment wherein a sheet travels upward, the edges 65*b* and 66*b* of the guide plates 65 and 66 directly above the openings 67 and 68 are bent so that they are spaced from each other at an interval that increases as they extend downward, and the edge 65*b* is not therefore located directly above the opening 67 in the vertical direction. Therefore, even if water droplets hit regions of the guide plate 65 above the opening 67 and drop from the edges 65*b* and 66*b*, they will not directly penetrate into a sheet S. Thus, the present embodiment makes it possible to reduce the possibility of the occurrence of wrinkles and breakage.

F. Modification of Sprinkler

Figure 18:
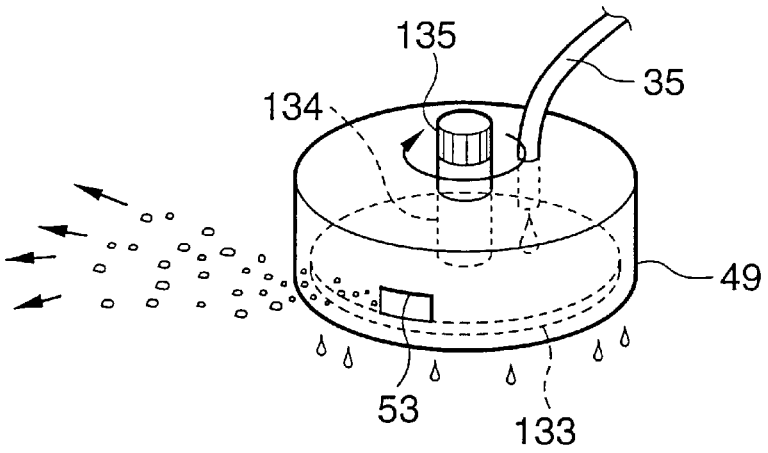
FIG. 18 is a perspective view of a modification of the rotor of the sprinkler.

FIG. 18 shows another rotor 133 which can be incorporated in the housing 32 to be used for the sprinklers 30 and 31. The upper and lower surfaces of the rotor 133 are flat discs which are rotatable about a vertical shaft 134. A toothed pulley 135 or a toothed wheel which is a part of a wheel train rotated by an endless belt is secured to the upper end of the vertical shaft 134, which rotates the rotor 133 in one direction. This rotor 133 is also located in the inner case 49 as in the above-described embodiment to splash water from the supply pipe 35 when rotated. Thus, water is ejected from the slit 53.

Alternatively, a sprinkler may be employed in which a spray nozzle is incorporated in the housing 32 in place of the rotor and inner case 49.

G. Modification of Guide Plates

Figure 19:
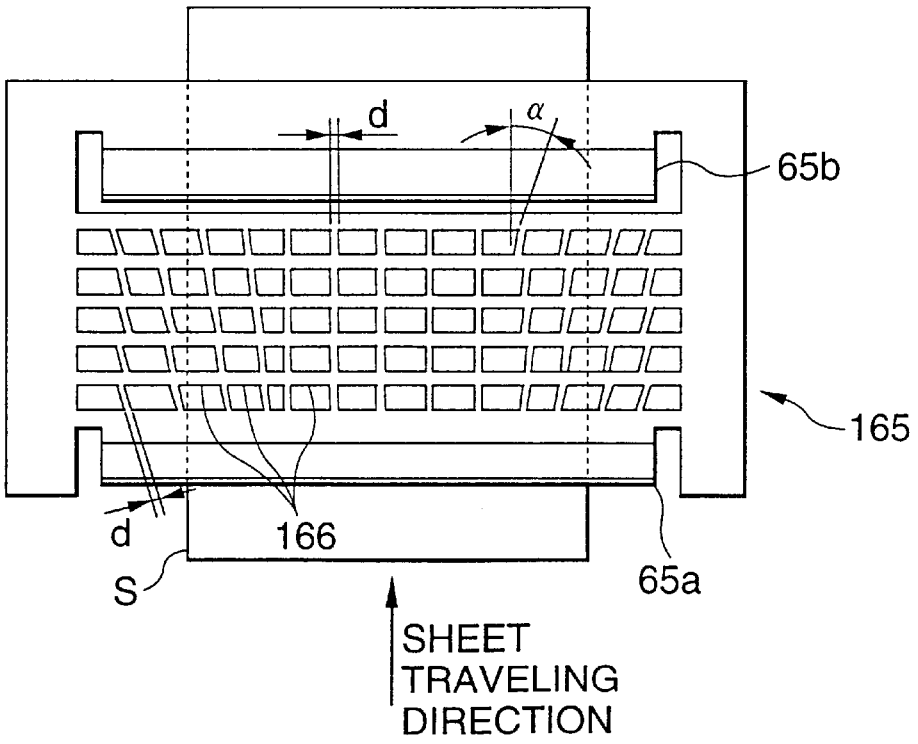
FIG. 19 is a front view of a modification of the guide plate.

FIG. 19 shows a guide plate 165 which can be used in place of the guide plates 65 and 66. The guide plate 165 is formed with a lower edge 65*a* and a side edge 65*b* similar to those of the guide plate 65. However, it is not formed with the openings 67 and 68 and is formed with a plurality of holes 166 through which water droplets sprinkled by the sprinkler pass. Therefore, the guide plate 165 can guide the sheets S and can allow water droplets to land on the sheets S passing therethrough at the same time.

Holes 166 are in the form of parallelograms, and the those in the middle are in the form of squares. The interval d between the holes 166 (i.e., the width of the grid that defines the holes 166) is preferably smaller than the diameter of normal droplets sprinkled by the sprinkler to reach the cut sheets S. For example, the interval d is preferably less than 1 mm and more preferably less than 0.2 mm when the diameter of normal droplets is 1 mm. Such a small interval d makes it possible to increase the area on a cut sheet S wetted by water.

Outer parts of the grid are at an angle to the vertical, i.e., to the traveling direction of the cut sheets S so that the interval between the linear bodies generally increases with the distance traveled by the cut sheets S downstream. The angle $\alpha$ of the inclination is about 5°. The purpose is to prevent the sheet from jamming as described above with reference to the linear bodies 69 and 70.

H. Example of Improvement on Water Container

Figure 20:
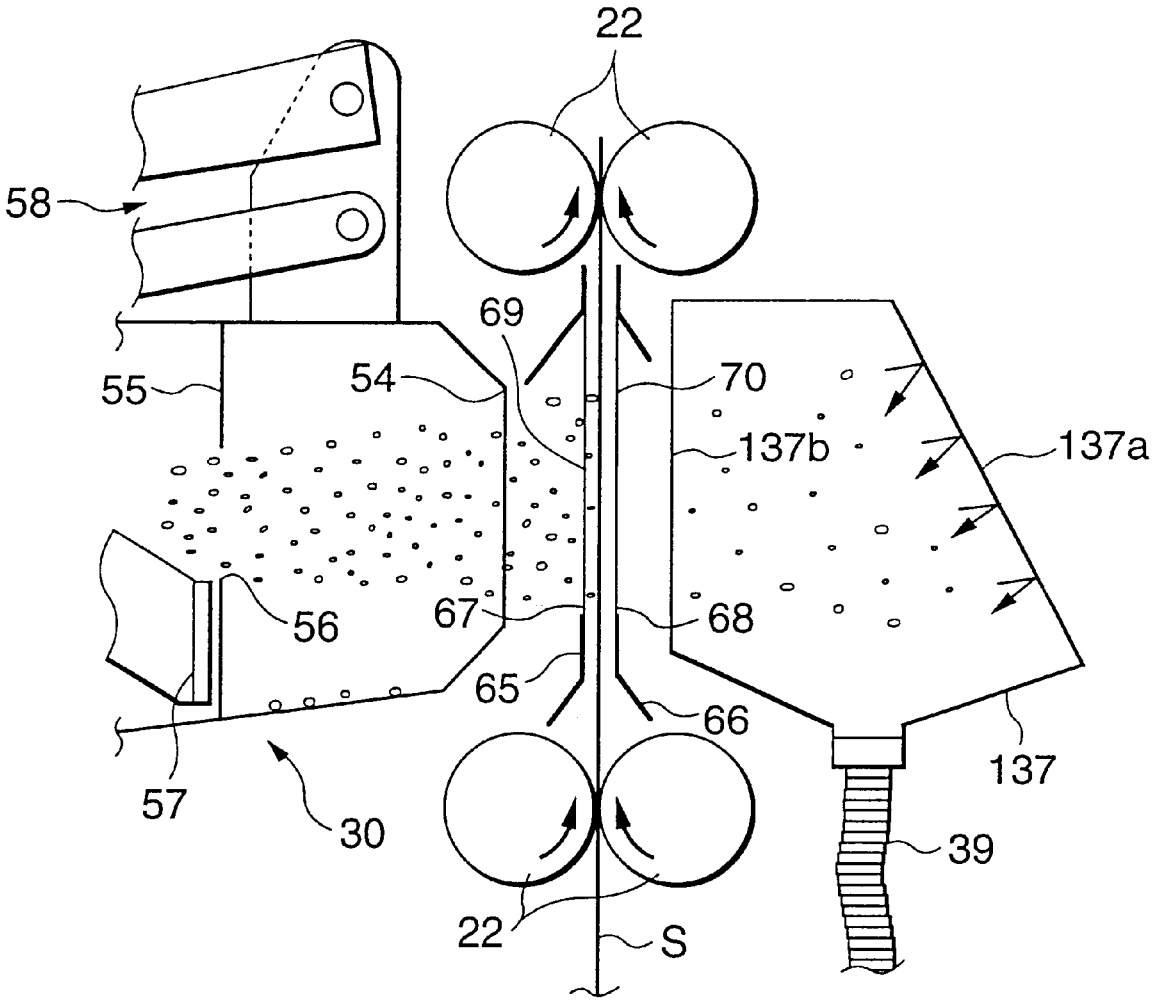
FIG. 20 is a sectional view of a modification of the water container used in for the sprinkler.

FIG. 20 shows an example of improvement on the water container 37. A rear wall 137*a* of a water container 137 of this example of improvement, i.e., the wall hit by water droplets which have entered through the opening, is inclined such that the water container 137 is wider in the lower part thereof. As a result, water droplets which have entered the water container 137 proceed toward the bottom wall even if they are reflected by the rear wall 137*a*, which reduces the water that exit through an opening 137*b* to a very small amount.

This makes it possible to reduce the risk of troubles caused by water that further drops upon underlying components. Further, since the ratio of the sprinkled water collected in the tank 40 is increased, the time and labor required to replenish the tank 40 with water can be reduced.

Figure 21:
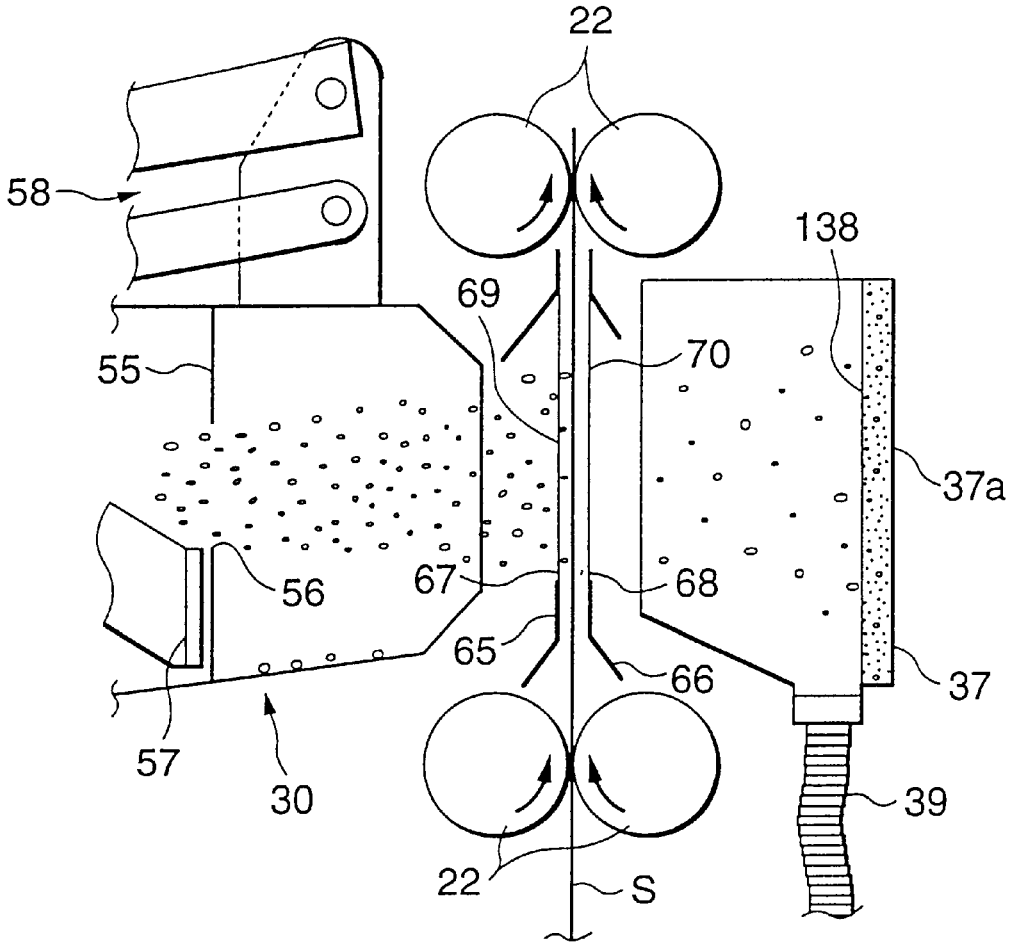
FIG. 21 is a sectional view of another modification of the water container.

FIG. 21 shows another example of improvement on the water container 37. The water container of this example of improvement has a vertical rear wall 37*a* similarly to that shown in FIG. 5. A cushion 138 is secured to the inner surface of the rear wall 37*a* to suppress the reflection of incoming water droplets and to minimize the speed of reflected water droplets. The cushion 138 is preferably made of a soft and porous material such as cloth, unwoven fabric or sponge. The cushion 138 reduces the water that exit through the opening 137*b* to a very small amount. Since the water container has smaller dimensions and occupies a smaller area compared to the water container 137 shown in FIG. 20, it contributes to the reduction of the size of an apparatus.

I. Control of Sprinkler

Figure 22:
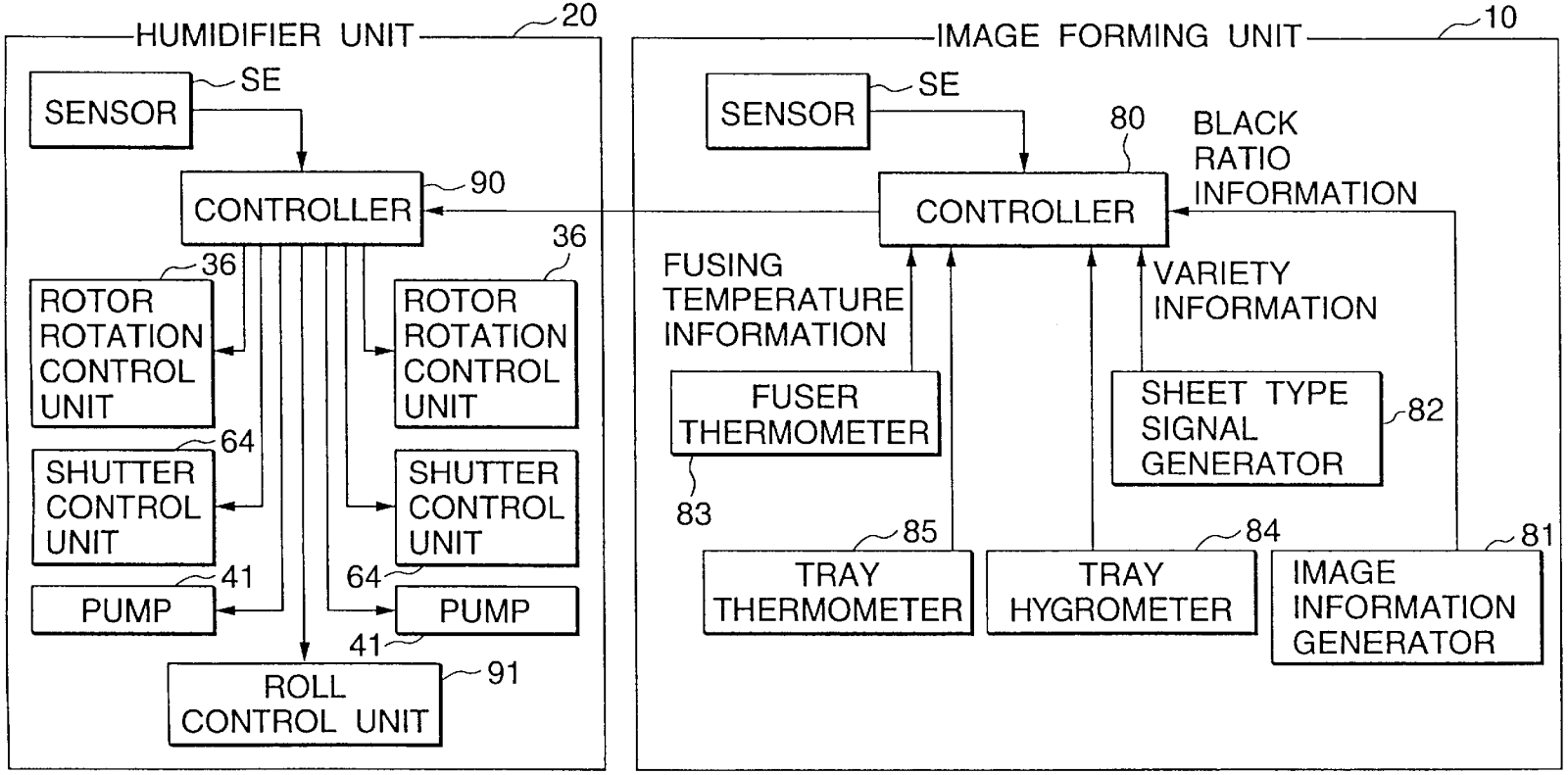
FIG. 22 is a block diagram of a control system of the image forming apparatus.

FIG. 22 illustrates features of a control system of the above-described image forming apparatus. This control system includes a controller 80 for the image forming unit 10 and a controller 90 for the sheet humidifier unit 20. The controller 80 for the image forming unit 10 controls the image forming process performed by the photosensitive drum 11, fuser 15 and the like and the sheet transport process performed by the rotating rolls. An image information generator 81, a sheet type signal generator 82, a fuser thermometer 83, a tray hygrometer 84, a tray thermometer 85 and a sensor SE are connected to the controller 80.

Figure 1:
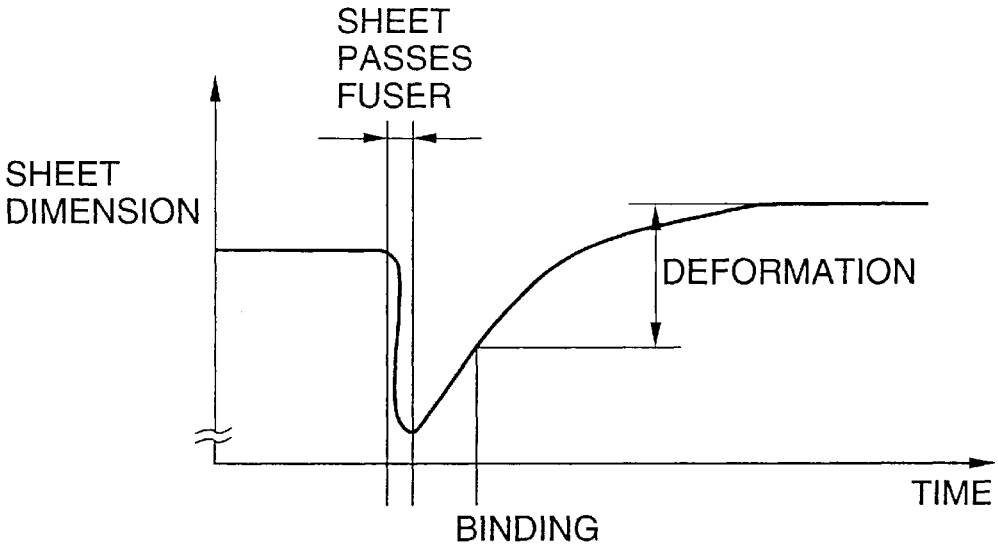
FIG. 1 is a graph showing changes of dimensions of a sheet as time passes during the formation of images thereon utilizing an electrophotographic system.
Figure 2:
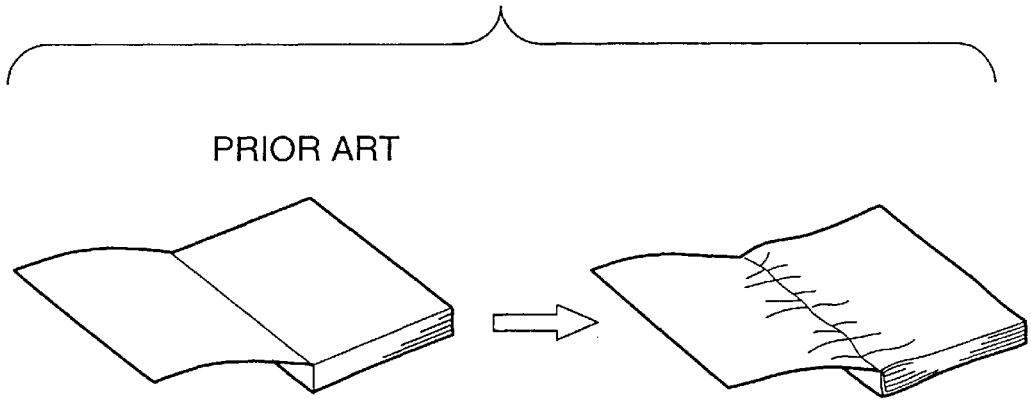
FIG. 2 schematically illustrates deformation of a completed book after binding which is a problem with the prior art.

The image information generator 81 supplies an image signal to the latent image writing device 12 (see FIG. 1) for writing a latent image on the photosensitive drum 11. When the image forming apparatus is a copier, the image information generator 81 generates the image signal based on the information of an original image read by a scanner which is not shown. When the image forming apparatus is a printer, the image information generator 81 generates the image signal based on a signal supplied from the outside. Immediately after the generation of an image signal for one side of a single sheet S, the image information signal generator 81 calculates the ratio of black regions (black ratio on that side based on the image signal. For example, the black ratios of the front side of a first sheet, the rear side of the same sheet and the front side of a second sheet may be 10%, 12% and 8%, respectively. The black ratio information for each side is supplied to the controller 80.

The sheet type information signal generator 82 supplies type information indicating the type of the cut sheets S contained in the container tray 100 to the controller 80. For example, the sheet type information may include weight (the weight of a sheet per unit area). The sheet type information generator 82 may be a thickness sensor for measuring the thickness of traveling sheets S provided halfway the transport path 21 for the sheets S. For example, the thickness of a sheet can be estimated from displacement of the sensor by arranging the sensor such that it is displaced when a sheet reaches the same. Alternatively, the generator may be a user interface which allows a user to input the type of sheets S. When a plurality of sheet container trays 100 are provided, an arrangement may be made in which each of the trays are associated with sheet types in advance and in which type information is transmitted from an user interface when a tray is selected with the user interface.

The cut sheets S may be categorized into sheets of paper and OHP sheets made of resin. In this case, the sheet type information signal generator 82 may be a user interface which allows a user to input the type of sheets S. When a plurality of sheet container trays 100 are provided, an arrangement may be made in which each of the trays are associated with sheet types in advance and in which type information is transmitted from an user interface when a tray is selected with the user interface.

Referring further to the sheet types, the cut sheets S may be categorized into normal sheets supplied from the container tray 100 and insert sheets supplied from the container tray 110. In this case, the sheet type information signal generator 82 may be a user interface that allows a user to specify positions in a book where insert sheets are to be provided.

The fuser thermometer 83 is provided at the fuser 15 to supply fusing temperature information depending on the temperature of the fuser 15 to the controller 80.

The tray hygrometer 84 and tray thermometer 85 are provided at the container tray 100 to respectively supply tray humidity information depending on the humidity in the tray and tray temperature information depending on the temperature in the tray to the controller 80.

The black ratio information, type information, fusing temperature information, tray humidity information and tray temperature information are parameters for determining a proper amount of moisture to be supplied to the cut sheets S. For example, when the black ratio is high, a great amount of water is to be supplied because a great amount of toner is used to accumulate a large amount of heat. In the case of thick paper which is heavy, a great amount of water must be supplied because it accumulates a great amount of heat. While water must be supplied to a sheet of paper, there is no need for supplying water to an OHP sheet which is free from fluctuation of dimensions depending on the water content. Further, there is no need for supplying water to the insert sheets supplied from the container tray 110 because they are not subjected to the fusing process performed by the fuser 15 (see FIG. 3). Based on such data and information, the controller 80 determines the amount of water to be supplied to each side of each sheet and transfers data of the amount of supplied water to the controller 90.

The ambient humidity and temperature of the image forming apparatus may be used as parameters for determining the amount of water instead of or in addition to the information on the internal environment such as the fusing temperature information, tray humidity information and tray temperature information described above. In this case, a hygrometer and a thermometer are provided outside the apparatus; humidity information and temperature information as a result of the measurement are supplied to the controller 80; and the controller 80 determines the amount of water based on the information.

While the sensor SE connected to the controller 80 is shown as one block in FIG. 22, a plurality of sensors are actually provided in a plurality of locations in the vicinity of the transport path 21 inside the image forming unit 10 as shown in FIG. 3. Each of the sensors SE is, for example, a light-reflection type sensor which is capable of detecting the arrival of the leading edge of a sheet S at the sensor SE and the passage of the rear edge of the sheet S through the sensor SE. When the sensor SE does not detect the arrival or passage of the sheet at predetermined timing, it means that jamming has occurred. In such cases, the controller 80 stops the supply of power to the photosensitive drum 11 and fuser 15 and causes a user interface to display an error message. In such cases, the controller 80 also generates a jam occurrence signal and transmits it to the controller 90.

Rotor rotation control units 36, pumps 41, shutter control units 64 and sensors SE are connected to the controller 90. Two each rotor rotation control units 36, pumps 41 and shutter control units 64 are provided to accommodate the two sprinklers 30 and 31. A roll control unit 91 for controlling the driving of the multiplicity of transport rolls 22 (see FIG. 3) is connected to the controller 90.

The controller 90 turns the rotor rotation control unit 36 on as needed to rotate the rotors 33 of the sprinklers 30 and 31 at a constant speed, and turns the rotor rotation control unit 36 off when there is no need for rotation to stop the rotors 33. Further, the controller 90 turns the shutter control units 64 as needed to close the intermediate slits 56 with the shutters 57, and turns the shutter control units 64 off when the need is eliminated to lower the shutters 57 to open the intermediate slits 56. The roll control unit 91 is turned on when a cut sheet S is transported from the image forming unit 10.

Furthermore, based on the data on the amount of supplied water transferred from the controller 80, the controller 90 controls the rotating speed of the relevant pump 41 when each sheet S faces the sprinkler 30 and 31. For example, the speed of rotation of the pump 41 is increased when the black ratio is high. When images are to be formed on both sides of a sheet, the controller may separately control the speed of rotation of the pump 41 for the front side and the speed of rotation of the pump 41 for the rear side based on the black ratios on the front and rear sides to supply different amounts of water on those sides.

In the case of thick paper which is heavy, the speed of rotation of the pump 41 is increased. In the case of an OHP sheet or insert sheet, the pump 41 is stopped to supply no water. Thus, an optimum amount of water can be supplied to each side of each sheet based on various parameters, which makes it possible to improve the quality of a book made by the binding unit further.

As a modification, the data of the amount of supplied water may be calculated by the controller 90. In this case, the controller 80 supplies data such as black ratio information, type information, fusing temperature information, tray humidity information and tray temperature information to the controller 90 which in turn determines the amount of water to be supplied to each side of each sheet based on those data.

While the sensor SE connected to the controller 90 is shown as one block in FIG. 22, a plurality of sensors are actually provided in a plurality of locations in the vicinity of the transport path 21 inside the sheet humidifier unit 20 as shown in FIG. 3. Reference symbols SE1 and SE2 in FIG. 3 represent the sensors SE. Each of the sensors SE is, for example, a light-reflection type sensor which is capable of detecting the arrival of the leading edge of a sheet S at the sensor SE and the passage of the rear edge of the sheet S through the sensor SE. When the sensor SE does not detect the arrival or passage of the sheet at predetermined timing, it means that jamming has occurred.

In such cases, the controller 90 causes a user interface to display an error message and turns the shutter control units 64 on to close the intermediate slits 56 with the shutters 57. The operation of the shutters 57 makes it possible to avoid unnecessary spraying of water. Even when a sheet S is stopped in the vicinity of the sprinklers 30 and 31, excessive supply of water to the sheet S is prevented to avoid damage on the sheet S such as breakage. In order to reduce unnecessary consumption of energy, the rotor rotation control unit 36 may be turned off to step the rotors 33, and the rotation of the pumps 41 may be stopped to stop supply of water to the sprinklers 30 and 31. The controller 90 operates similarly when it receives a jam occurrence signal as described above from the controller 80 of the image forming unit 10.

J. Examples of Shutter Operation

Figure 23:
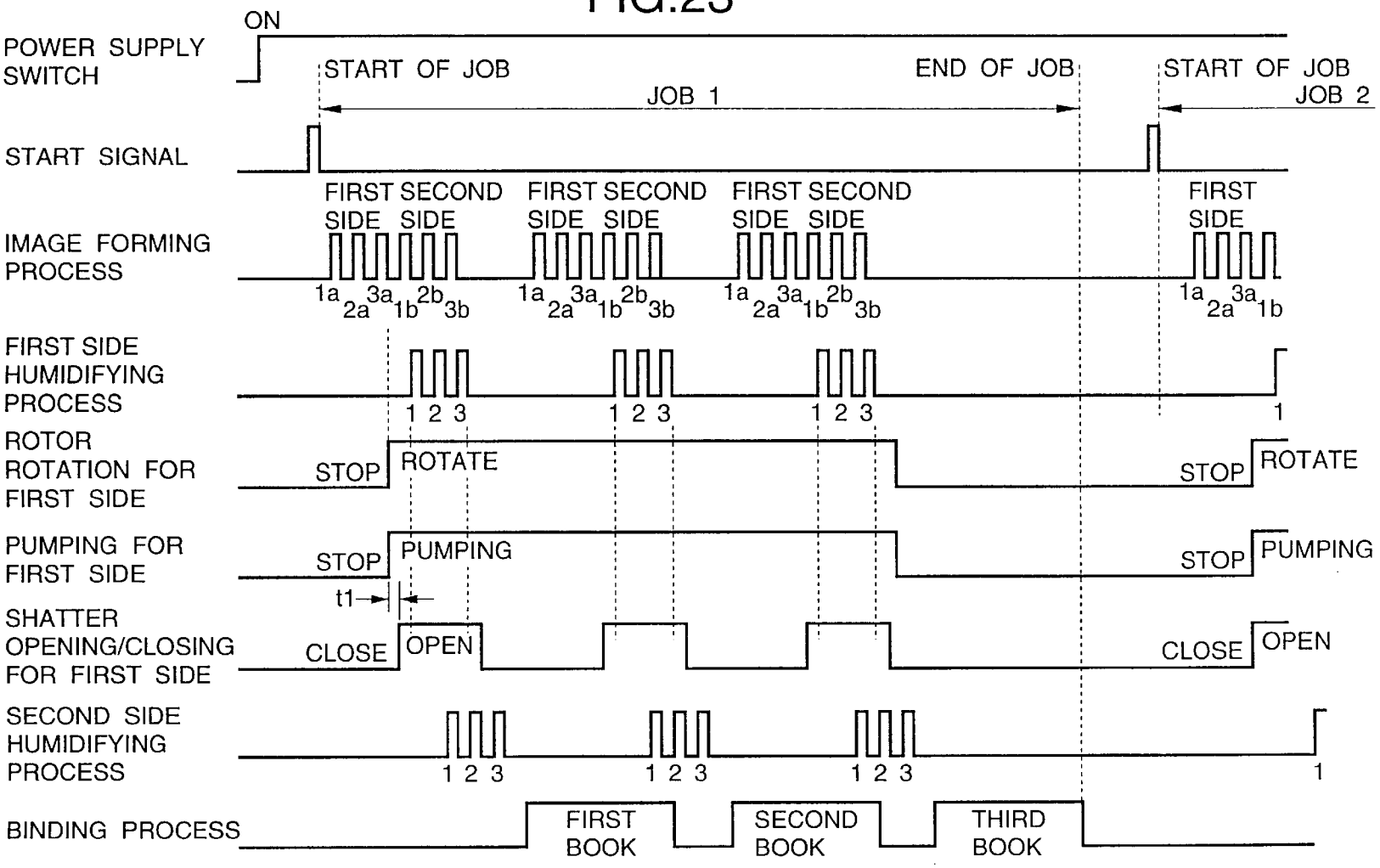
FIG. 23 is a timing chart showing an example of the operation of the image forming apparatus.

A description will now be made on various examples of the operation of the shutter 57 of the present embodiment. FIG. 23 is a timing chart showing an example of the operation of the image forming apparatus. In this operation, the shutter 57 is opened and closed once during the passage of a series of a plurality of sheets required for making one book. As shown in FIG. 23, when a start signal is supplied with the power supply switch of the image forming apparatus in an on position, the image forming process is started in the image forming unit 10 after a short period of time. The start signal is supplied by the user operating on a user interface which is not shown.

The image forming process first forms images on first sides of a required number of sheets and forms images on second sides of those sheets. The numbers 1, 2 and 3 in FIG. 23 represent the order of the sheets in one book, and the letters a, b represents first side, second side, respectively. For the illustrated example, it is assumed that three sheets are required for one book. That is, one book is constituted by three sheets S with images formed on both sides thereof. In this example, a plurality of (three) books are provided one cycle of job. Therefore, the formation of images on both sides of three sheets for one book is followed by the image forming process for the next book with a short interval between them (the process 1*a* follows the process 3*b* with a short interval in FIG. 23).

Cut sheets S with images formed on both sides thereof are sequentially transported to pass the sprinkler 30 in the vicinity thereof. At this point, the sprinkler 30 performs a humidifying process on the first sides of the sheets. In order to perform the humidifying process on the first sides, the rotor 33 and pump 41 for the first sides, i.e., for the sprinkler 30, are activated a short time before the humidifying process on the first sheet of the first book. The shutter 57 of the sprinkler 30 is also opened a short time before the humidifying process on the first side. In order to supply water to the sheets at a stable flow rate from the beginning, the shutter 57 is opened at a time interval of t1 from the activation of the rotor 33 and pump 41.

In order to supply water to every sheet at a stable and constant flow rate, the rotor 33 and pump 41 are continuously driven during the humidifying process on all sheets in one job and are stopped after the humidifying process is completed on the last sheet. The shutter 57 is kept open during the passage of the series of three sheets required to form one book and is closed after the last sheet for each book passes. The shutter 57 is opened again a short time before the humidifying process on the first sheet for the next book.

Each sheet passes the sprinkler 30 in the vicinity thereof and then passes the sprinkler 31 in the vicinity thereof. That is, each sheet is subjected to a humidifying process on the second side after the humidifying process for the first side. The rotor 33, pump 41 and shutter 57 for the sprinkler 31 are operated for the humidifying process on the second side. Although the operations of the rotor 33, pump 41 and shutter 57 during the humidifying process on the second side are not shown, they are similar to those in the first humidifying process. The rotor 33 and pump 41 are continuously driven during the humidifying process on all sheets in one job and are stopped after the humidifying process is completed on the last sheet. The shutter 57 is kept open during the passage of the series of three sheets required to form one book and is closed after the last sheet for each book passes. The sheets S which have been subjected to the second humidifying process are transported to the binding unit to be subjected to a binding process.

In such a process, the shutter 57 of each of the sprinklers 30 and 31 is kept open during the passage of a series of a plurality of sheets required to form one book and is closed after the last sheet for one book passes. Therefore, while the shutter 57 is closed, no water is sprinkled out of the housing 32 even though the rotor 33 ejects water, and water supplied through the supply pipe 35 is substantially entirely collected. This makes it possible to reduce the number of operations of replenishing the tank 40 with water. Such a process is preferable in a situation wherein sheets are transported at a high speed and wherein the sheets required for each book are brought into face-to-face relationship with the sprinklers 30 and 31 with short time intervals.

Figure 24:
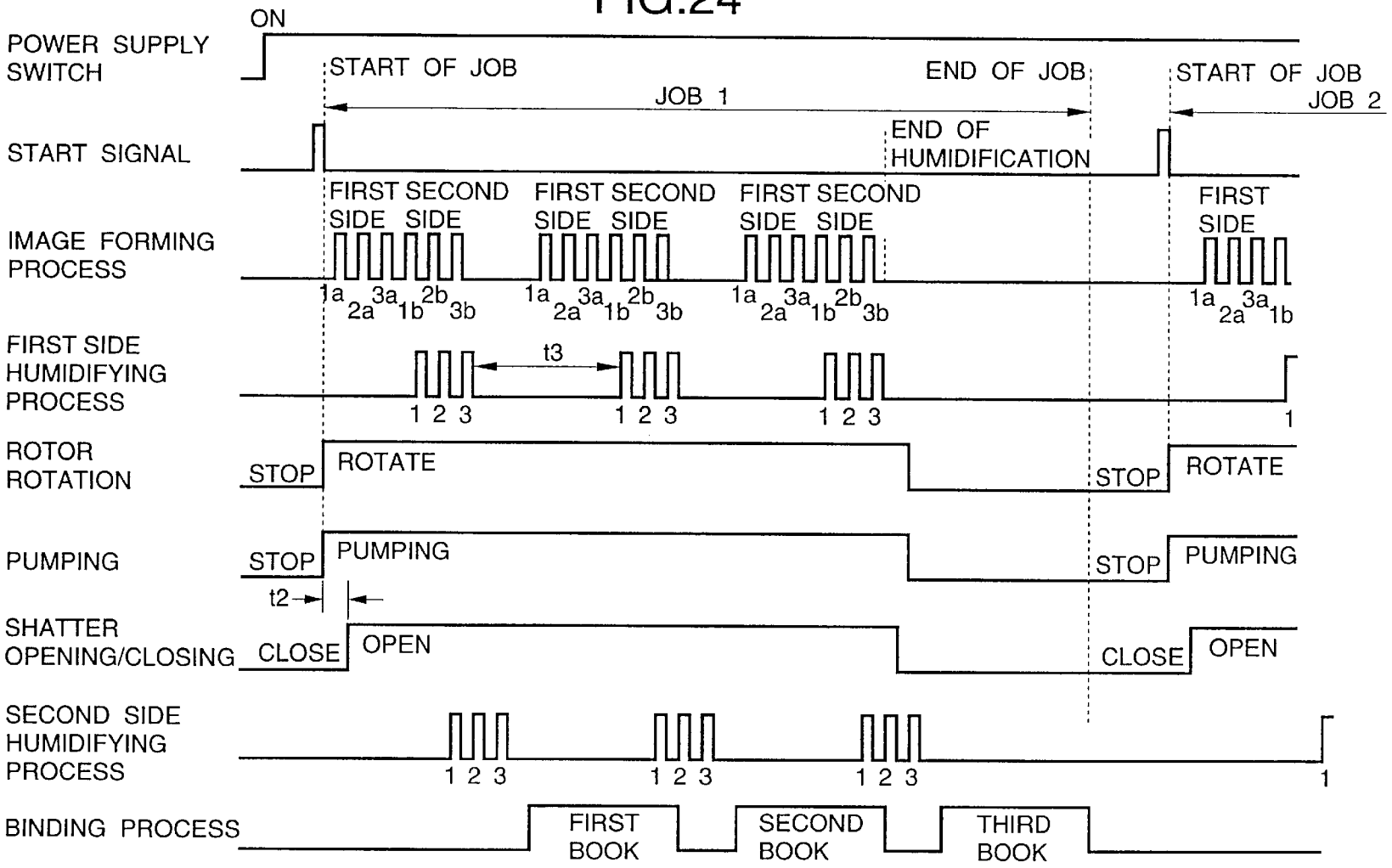
FIG. 24 is a timing chart showing another example of the operation of the image forming apparatus.

FIG. 24 is a time chart showing another example of the operation of the image forming apparatus. In this operation, the shutter 57 is opened and closed once for each job. As shown in FIG. 23, when a start signal is supplied with the power supply switch of the image forming apparatus in an on position, the rotor 33 and pump 41 of the sprinkler 30 for the humidifying process on the first side are activated, and the shutter 57 is opened after the speeds of rotation of them become stable (at a time interval of t2). The rotor 33 and pump 41 are continuously driven and the shutter 57 is kept open during the humidifying process on all of cut sheets S required for three books fabricated in one job. The shutter 57 is closed after the last sheet in one job passes, and the rotor 33 and pump 41 are thereafter stopped. Such a process is preferable in a situation wherein sheets are transported at a high speed and wherein the sheets required for each book are brought into face-to-face relationship with the sprinklers 30 and 31 with short time intervals. It is especially preferable when the sheets for the second book pass after the passage of the sheets for the first book at a short time interval (t3 in FIG. 24).

Figure 25:
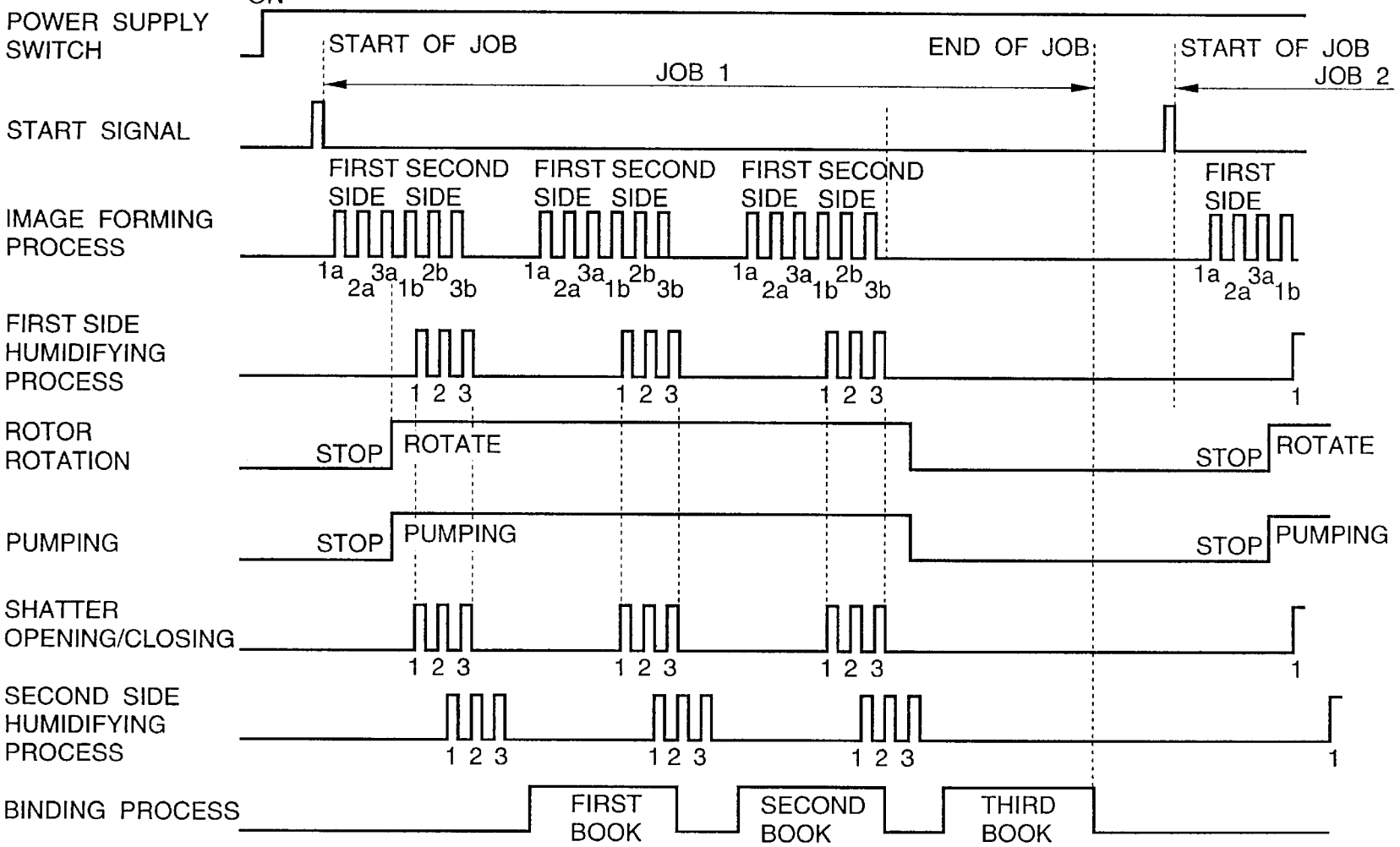
FIG. 25 is a timing chart showing still another example of the operation of the image forming apparatus.

FIG. 25 is a time chart showing another example of the operation of the image forming apparatus. In this operation, the shutter 57 is opened and closed each time a sheet passes the sprinklers 30 and 31 in the vicinity thereof. In order to supply water to every sheet at a stable and constant flow rate, the rotor 33 and pump 41 are continuously driven during the humidifying process on all sheets in one job and are stopped after the humidifying process is completed on the last sheet.

The process shown in FIG. 25 is preferable in a situation wherein sheets are transported at a low speed and wherein the sheets are brought into a face-to-face relationship with the sprinklers 30 and 31 at long time intervals. In order to perform such a process, as shown in FIG. 3, a sensor SE1 for detecting the leading edge of a sheet S may be provided upstream of the sprinklers 30 and 31, and the shutter 57 may be opened when the sensor SE1 detects the sheet S. Alternatively, a sensor SE2 for detecting the passage of the rear edge of a sheet S may be provided downstream of the sprinklers 30 and 31, and the shutter 57 may be closed when the sensor SE2 detects the passage of the sheet S.

K. Example of Alteration of Order of Units

Figure 26:
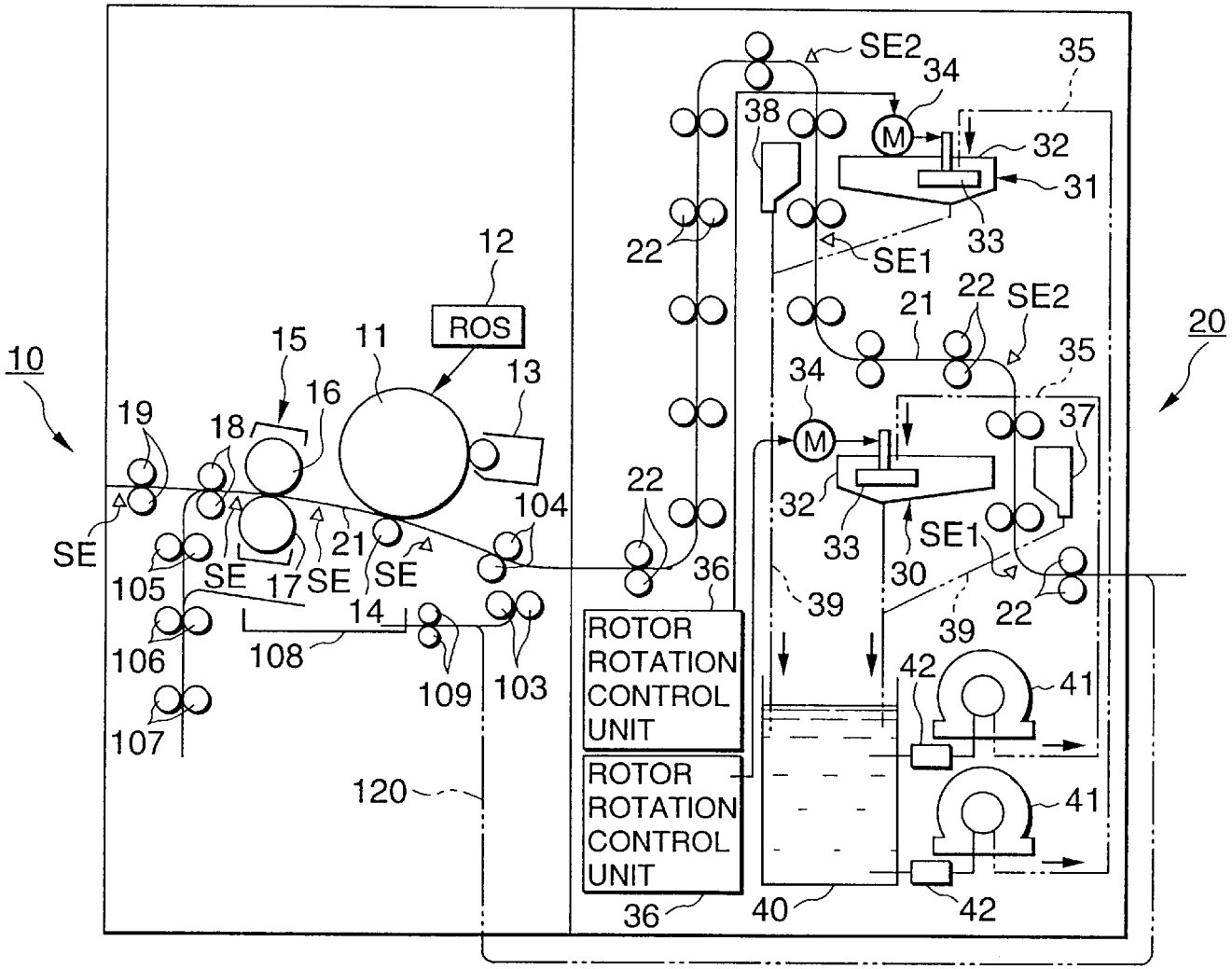
FIG. 26 is a schematic view of a modification of the image forming apparatus.

FIG. 26 shows a modification of the image forming apparatus. Components which are common between FIG. 26 and the above-described embodiment are indicated by like reference numbers and will not be described here. In this example, the order of the image forming unit 10 and sheet humidifier unit 20 has been changed. Therefore, a cut sheet traveling along the transport path 21 first passes the sheet humidifier unit 20 and then passes the image forming unit 10. As a result, the sprinklers 30 and 31 first supply water to both sides of the sheet, and the image forming unit 10 thereafter forms images. When the cut sheet is extremely dry before the formation of images, the quality of the images formed may be adversely affected. In this modification, since water droplets are sprinkled upon such a cut sheet, the image quality can be improved.

A cut sheet S on which an image has been formed on one side thereof by the image forming unit 10 and which has been inverted by inversion rolls 105, 106 and 107 may be transferred along the transport path 120 indicated by two-dot chain line in FIG. 26 to be introduced into the sheet humidifier unit 20 again. In this case, the sheet which has been dried as a result of heating by the fuser 15 is humidified again by the sheet humidifier unit 20. Thereafter, the sheet is introduced into the image forming unit 10 to form an image on the side opposite to the side already having an image formed thereon. The quality of the image formed on the second side is thus improved.

L. Binding Unit

Figure 27:
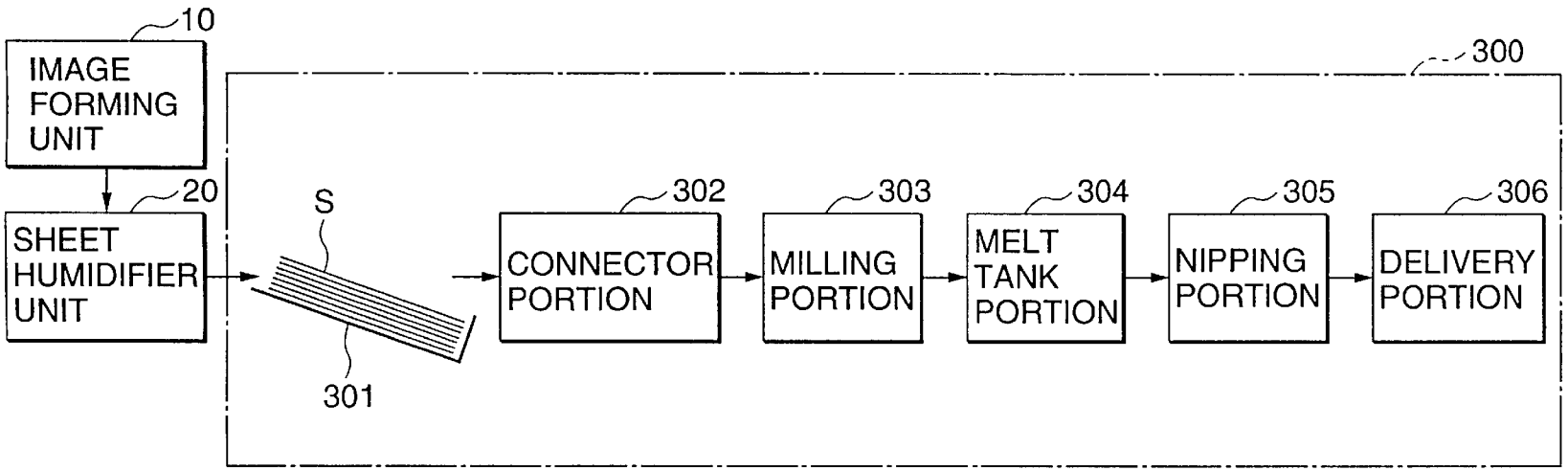
FIG. 27 is a block diagram showing a schematic configuration of a binding system according to the invention having the image forming apparatus, sheet humidifier unit and binding unit.
Figure 28A:
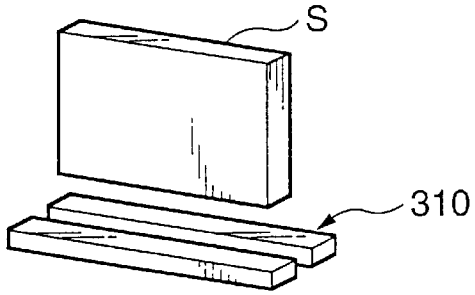
FIGS. 28A, 28B, 28C and 28D illustrate operational steps of the binding unit.
Figure 28B:
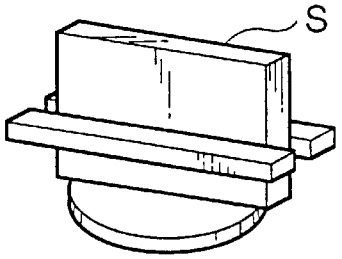
Figure 28C:
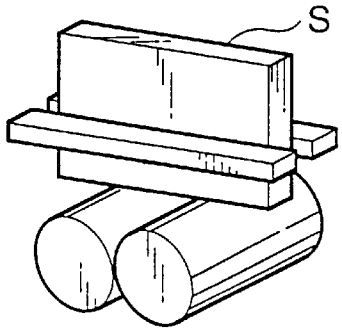
Figure 28D:
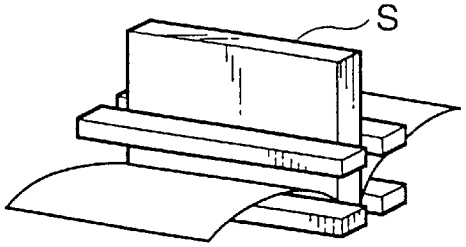

The cut sheet S is transferred to a binding unit 300 shown in FIG. 27 after the formation of images by the image forming unit 10 and humidification by the sheet humidifier unit 20 to recover the sheet dimensions as described above. As shown in FIG. 27, the binding unit 300 is equipped with a sheet container portion 301, a connector portion 302, a milling portion 303, a melt tank portion 304, a nipping portion 305 and a delivery portion 306.

The sheet container portion 301 includes a tray capable of containing cut sheets S humidified by the sheet humidifier unit 20 which contains a predetermined number of cut sheets S sent from the sheet humidifier unit 20. As shown in FIGS. 28A, 28B, 28C and 28D, the connector portion 302 picks up and aligns the predetermined number of cut sheets S contained in the sheet container portion 301 and inserts them to a clamper 310.

Thereafter, the milling portion 303 mills the back portions of the plurality of cut sheets S and forms grooves in that region. The melt tank portion 304 applies glue to the region formed with grooves by the milling portion 303. After the melt tank portion 304 applies glue, the nipping portion 305 applies a cover sheet to the bunch of cut sheets S with glue applied thereon which is then press-molded into a book. Books formed in such a manner are sequentially stocked in the delivery portion 306. Thus, cut sheets S having images formed thereon by the image forming unit 10 are transferred through the sheet humidifier unit 20 to the binding unit 300 to be bound into a book. Since cut sheets S are transferred to the binding unit 300 after being humidified by the sheet humidifier unit 20 to recover the sheet dimensions, the occurrence of waves and the like on each of bound sheets can be reduced.

Figure 29:
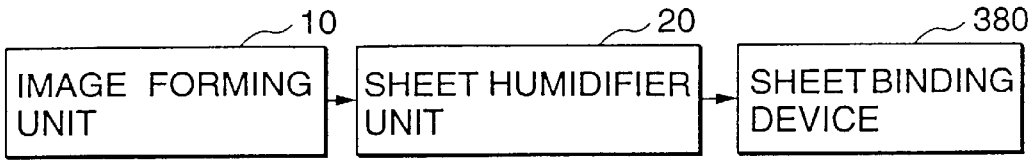
FIG. 29 is a block diagram showing a schematic configuration of a modification of the binding system.
Figure 30A:
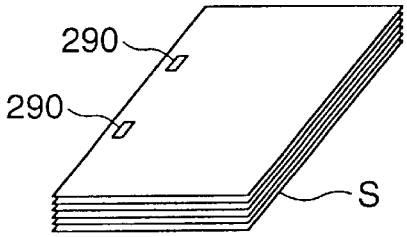
FIGS. 30A and 30B illustrate books formed according to a modification of the binding system.
Figure 30B:
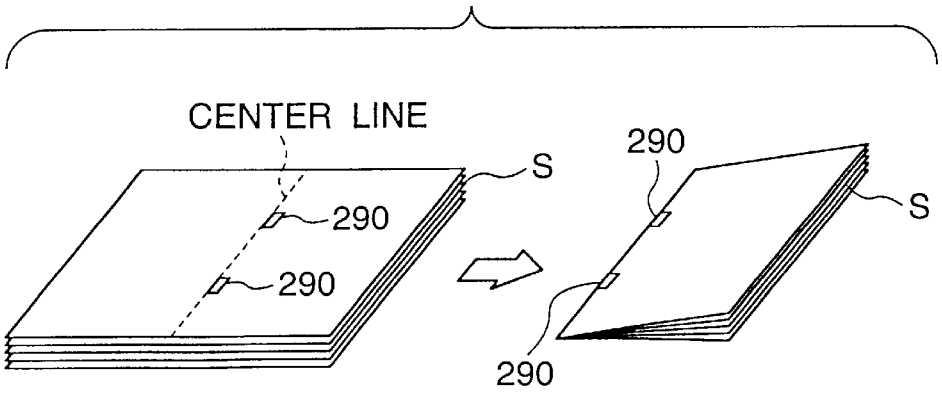

The above-described binding unit 300 may be replaced with various binding means for forming a book by binding a plurality of cut sheets. For example, as shown in FIG. 29, a sheet binder (binding means) 380 for binding with staplers may be provided downstream of the sheet humidifier unit 20 to configure a binding system. In such a binding system, after stacking a plurality of cut sheets sent by the sheet humidifier unit 20, a book may be formed by binding the bunch of cut sheets S with staples 290 in a plurality of locations (two locations in the figure) at one end thereof as shown in FIG. 30A. Alternatively, as shown in FIG. 30B, the bunch of cut sheets S may be bound with staples 290 in a plurality of locations in the center and may folded to form a book. The use of such a sheet binder for binding makes it possible to reduce the occurrence of waves and the like on each sheet of a completed book like the above-described binding unit 300.

M. Modification of Sheet Humidifier unit

In the above-described sheet humidifier unit, the sprinklers 30 and 31 are used to supply water to cut sheets S. Water can be supplied to cut sheets S using a device as described below.

Figure 31:
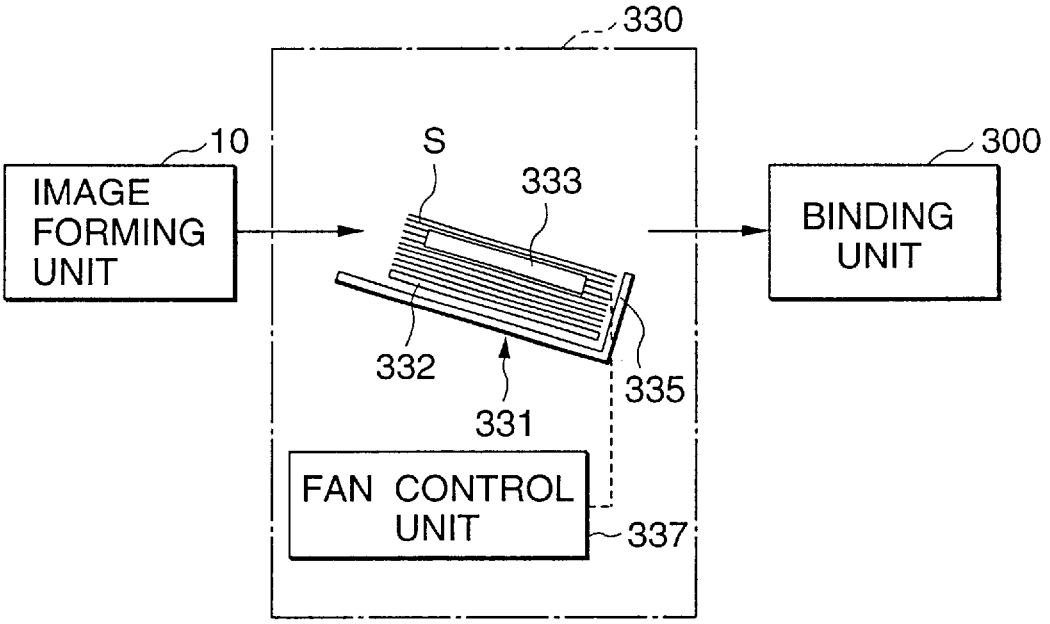
FIG. 31 is a sectional view showing a schematic configuration of a modification of the sheet humidifier unit.

(1) FIG. 31 shows the configuration of a modification of the sheet humidifier unit. As shown in FIG. 31, a sheet humidifier unit (humidity adjusting means) 330 includes a stack tray 331 for stacking cut sheets S having images formed thereon transferred from the image forming unit 10. The stack tray 331 includes a sheet stopper 335 for blocking the travel of cut sheets S, which causes cut sheets S transferred from the image forming unit 10 to be sequentially stored. The stack tray 331 has a bottom plate 332 movable in the vertical direction, and the position of the top of the cut sheets S contained in the stack tray 331 can be always kept constant regardless of the number of the stored sheets by controlling the position of the bottom plate 332.

Figure 32:
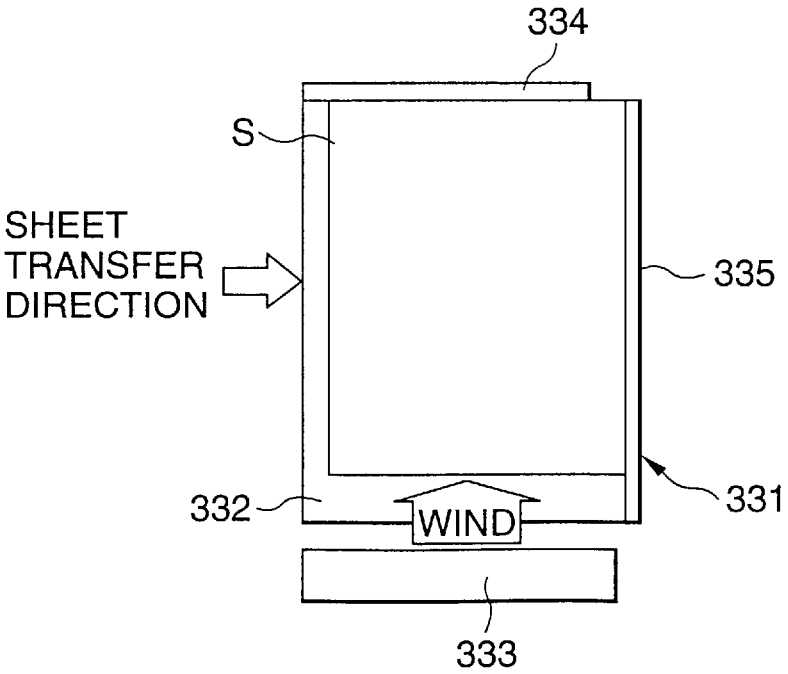
FIG. 32 is a plan view of a modification of the sheet humidifier unit.

FIG. 32 is a plan view of the sheet humidifier unit 330. As shown in FIG. 32, an axial flow fan 333 is disposed on one side of the stack tray 331 to supply a wind, i.e., a large amount of air toward the cut sheets S contained in the stack tray 331 based on a command from a fan control unit 337 (see FIG. 31). The axial flow fan 333 is disposed so as to blow a wind toward a position slightly lower than the top surface of the cut sheets S contained in the stack tray 331, which prevents the cut sheets S from being raised when the wind is blown.

A sheet stopper 334 having a slit thereon is provided at the end of the stack tray 331 opposite to the axial flow fan 333 to align the side edges of cut sheets transferred from the image forming unit 10 and to allow the wind blown by the axial flow fan 333 to pass. This improves the movement of air through the stack tray 331.

In such a configuration, when a predetermined number of cut sheets S are contained in the stack tray 331, the fan control unit 337 instructs the axial flow fan 333 to start blowing, thereby sending a wind from the axial flow fan 333. Moisture included in the air thus introduced is absorbed by the cut sheets S contained in the stack tray 331, and the cut sheets S is thus humidified. In the meantime, cut sheets S are sequentially transferred from the image forming unit 10 to be sequentially contained in the stack tray 331. However, since the bottom plate 332 is moved in accordance with the number of sheets contained as described above to keep the position of the top surface of the cut sheets S contained in the stack tray 331 constant, wind is blown to newly transferred cut sheets S to allow all cut sheets S to be humidified substantially uniformly humidified.

Further, by incorporating a humidifier to supply air having humidity higher than the ambient to the stack tray 331, a required amount of moisture can be supplied to the cut sheets S more quickly.

Instead of sequentially storing cut sheets S transferred from the image forming unit 10 in the stack tray 331 while blowing them with the axial flow fan 333 as described above, the axial flow fan 333 may be driven after all of the cut sheets S are contained. Alternatively, cut sheets S transferred from the image forming unit 10 may be stored while driving the axial flow fan 333 and humidified cut sheets S may be sequentially sent to the next step. Further, the fan control unit 337 may adjust the blowing time in accordance with black ratio information, type information, fusing temperature information and the like to supply an adequate amount of moisture to the contained cut sheets S similarly to the sheet humidifier unit 20 described above. A humidity sensor may be provided in the vicinity of the stack tray 331, and the fan control unit 337 may control the axial flow fan 333 for a duration in accordance with the ambient humidity detected by the humidity sensor. Alternatively, a fan capable of varying the amount of wind may be used to vary the amount of wind depending on the above-described black ratio information and the ambient humidity.

Figure 33:
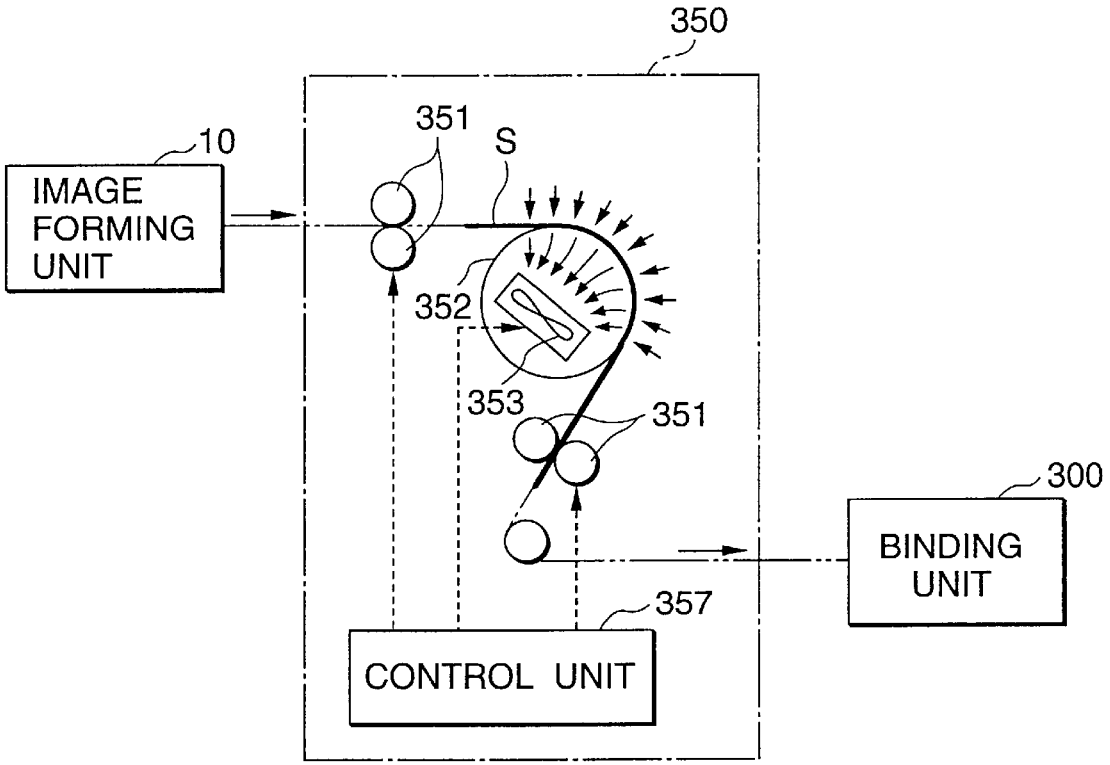
FIG. 33 is a side view showing a schematic configuration of another modification of the sheet humidifier unit.

(2) While a wind is introduced with cut sheets S stacked in the above-described sheet humidifier unit 330, as shown in FIG. 33, cut sheets S may be humidified during transportation by supplying a great amount of air. As shown in FIG. 33, in a sheet humidifier unit 350, cut sheets S transferred from the image forming unit 10 are guided along the path indicated by two-dot chain line in the figure by a plurality of pairs of transport rolls 351. A hollow cylindrical absorption roll 352 is provided in the transport path of the cut sheets S. The surface of the absorption roll 352 is in contact with the cut sheets S to function as a transport roll for guiding the cut sheets S along the path. Further, the surface of the absorption roll 352 is in the form of a net, which allows air to move into and out of the hollow in the absorption roll 352. In addition, an absorption fan 353 is provided in the hollow of the absorption roll 352 to absorb air in the direction indicated by the arrow in the figure. The absorption fan 353 and transport roll 351 are controlled by a control unit 357.

In such a configuration, when a sheet detection sensor (not shown) detects the transfer of a cut sheet S from the image forming unit 10, the control unit 357 instructs the transfer roll 351 and absorption fan 353 to start driving. When the absorption fan 353 starts absorption, air is absorbed from the side of the cut sheet S traveling along the absorption roll 352 opposite to the absorption roll 352 to the side of the absorption roll 352, and moisture included in the air is absorbed by the cut sheet S to humidify the cut sheet S. By absorbing air by the absorption fan 353 such that the air passes through the cut sheet S, moisture can be supplied in a time shorter than that required when the cut sheet S is blown as described above. In this case, by providing a humidifier or the like to keep the air absorbed by the absorption fan 353 at a high humidity, the required amount of moisture can be supplied to the cut sheet S in a shorter time.

Further, the control unit 357 may adjust the transport speed of the transport roll 351 in accordance with black ratio information, type information, fusing temperature information and the like to supply an adequate amount of moisture to the cut sheets S similarly to the sheet humidifier unit 20 described above. A humidity sensor may be provided in the sheet humidifier unit 350 to adjust the speed of the transportation of the cut sheets S by the transport roll 351 in accordance with the ambient humidity detected by the humidity sensor. A fan capable of varying the amount of absorbed wind may be used to vary the amount of absorbed wind depending on the black ratio information and the ambient humidity.

Figure 34:
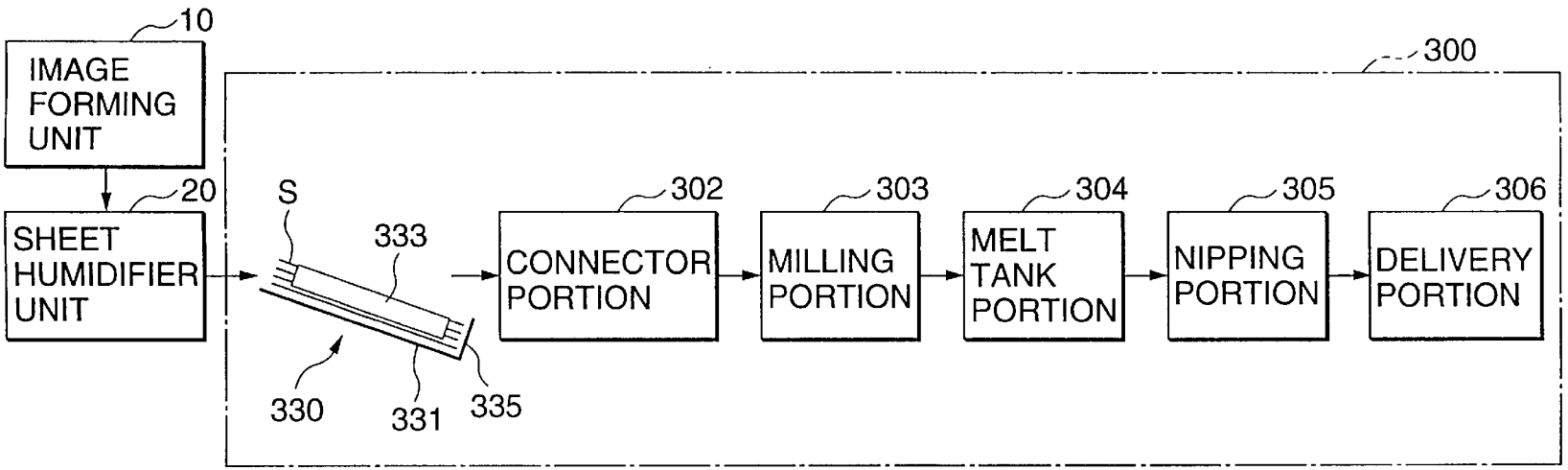
FIG. 34 is a block diagram showing a schematic configuration of a binding system including a binding unit incorporating a modification of the sheet humidifier unit.

(3) The sheet humidifier unit 330 shown in FIGS. 30A and 30B may be incorporated in the binding unit 300. In this case, as shown in FIG. 34, the sheet humidifier unit 330 may be provided in place of the sheet container portion 301 (see FIGS. 30A and 30B). The sheet humidifier unit 330 may be incorporated in the image forming unit 10.

Further, the sheet humidifier unit 350 may also be incorporated in the binding unit 300 and image forming unit 10.

N. Mode of Connection of Units

In the above-described embodiment, the image forming unit 10, sheet humidifier unit 20 and the like are directly connected to the binding unit 300 to perform image formation, adjustment of humidity and binding on cut sheets S being automatically transported between those units. This is not limiting the configuration of the binding system, and a mode of connection may be employed in which cut sheets S having images formed by the image forming unit 10 are stacked and in which the stacked cut sheets S are manually transported to the sheet humidifier unit 20. Alternatively, a mode of connection may be employed in which cut sheets S whose humidity has been adjusted by the sheet humidifier unit 20 are manually transported to the binding unit 300 and in which a bunch of cut sheets thus transported are bound into a book.

As described, present invention makes it possible to forcibly humidify cut sheets.

What is claimed is:

1. A sheet humidifier comprising:

transport means for transporting a cut sheet;

at least a pair of sheet guide portions facing each other for allowing the cut sheet transported by said transport means to pass therebetween in one direction and for exposing front and rear sides of said cut sheet;

a sprinkler provided outside said sheet guide portions for sprinkling water droplets toward one of said sheet guide portions to supply moisture to said cut sheet passing between said sheet guide portions; and a water container disposed opposite to said sprinkler across a position where the cut sheet transported by said transport means passes for receiving water droplets which have been sprinkled by said sprinkler but have not hit said cut sheet.

2. A sheet humidifier according to claim 1, wherein each of said pair of sheet guide portions comprises a plurality of linear bodies disposed substantially on a same plane as each of said pair of sheet guide portions and wherein water droplets can pass between said plurality of linear bodies.

3. A sheet humidifier according to claim 2, wherein at least some of said plurality of linear bodies are at an angle to a traveling direction of said cut sheet so that intervals between said plurality of linear bodies increase with a distance traveled by said cut sheet downward.

4. A sheet humidifier according to claim 1, wherein a plurality of linear bodies are thinner than the diameter of normal water droplets sprinkled by said sprinkler.

5. A sheet humidifier according to claim 1, wherein each of said sheet guide portions comprises a plate member formed with a plurality of holes through which water droplets can pass.

6. A sheet humidifier according to claim 1, wherein a first one of the pair of sheet guide portions faces the sprinkler, a second one of the pair of sheet guide portions is located such that the first one of the pair of sheet guide portions is between the sprinkler and the second one of the pair of sheet guide portions;

said cut sheet travels substantially upward;

said first one of the pair of sheet guide portions closer to said sprinkler is formed with an opening across which a plurality of linear bodies are stretched and provided with an edge serving as an upper end of said opening;

said edge is tapered such that it is spaced from said linear bodies at an interval that increases as it extends downward; and said opening is not located directly under said edge in a vertical direction.

7. A sheet humidifier comprising:

transport means for transporting a cut sheet;

a sprinkler for sprinkling water droplets toward the cut sheet transported by said transport means to supply moisture to said cut sheet; and a water container disposed opposite to said sprinkler across a position where the cut sheet transported by said transport means passes for receiving water droplets which have been sprinkled by said sprinkler but have not hit said cut sheet.

8. A sheet humidifier according to claim 7, comprising a cushion member disposed in said water container for being hit by said water droplets to suppress reflection.

9. A sheet humidifier according to claim 7, wherein said sprinkler is enclosed by a housing formed with a slit through which water droplets sprinkled by said sprinkler pass and wherein said slit limits a range of the water droplets sprinkled by said sprinkler in a traveling direction of said cut sheet.

10. A sheet humidifier according to claim 7, wherein a housing is provided with a port through which water droplets sprinkled by said sprinkler exit and includes an upper limit edge and a lower limit edge respectively serving as upper and lower ends of said port and wherein said upper limit edge does not protrude from a vertical plane on which said lower limit edge is located.

11. A sheet humidifier according to claim 7, comprising a water amount control means for controlling an amount of water sprinkled by said sprinkler means depending on a type of said cut sheet.

12. A sheet humidifier according to claim 7, wherein a water amount control means for nullifying an amount of water sprinkled by said sprinkler when said cut sheet is an OHP sheet.

13. A sheet humidifier according to claim 7, wherein a water amount control means nullifies an amount of water sprinkled by said sprinkler when said cut sheet is a cut sheet which does not pass through a fuser.

14. A sheet humidifier according to claim 7, comprising a water amount control means for controlling an amount of water sprinkled by said sprinkler in accordance with an image formed on said cut sheet.

15. A sheet humidifier according to claim 7, comprising a water amount control means for controlling an amount of water sprinkled by said sprinkler in accordance with an ambient temperature and a humidity.

16. A sheet humidifier according to claim 7, comprising:

blocking means provided between a position where the cut sheet transported by said transport means passes and said sprinkler for blocking a sprinkling path to prevent said water droplets sprinkled by said sprinkler from reaching the position where said cut sheet passes; and blocking control means for controlling a timing for blocking said path with said blocking means based on transport information of the cut sheet transported by said transport means.

17. A sheet humidifier according to claim 7, wherein a blocking control means drives a blocking means to open a sprinkling path before a series of cut sheets continuously transported by said transport means pass said sprinkler in the vicinity thereof and drives said blocking means to close said sprinkler after said series of cut sheets pass said sprinkler in the vicinity thereof.

18. A sheet humidifier according to claim 7, wherein a blocking control means drives a blocking means to open a sprinkling path before each cut sheet transported by said transport means passes said sprinkler in the vicinity thereof and drives said blocking means to close said sprinkler after said each cut sheet passes said sprinkler in the vicinity thereof.

19. A sheet humidifier according to claim 7, wherein a blocking control means drives a blocking means to open a sprinkling path when a cut sheet transported by said transport means jams.

20. A sheet humidifier comprising:

transport means for transporting a cut sheet;

at least a pair of sheet guide portions facing each other for allowing the cut sheet transported by said transport means to pass therebetween in one direction and for exposing front and rear sides of said cut sheet, wherein each of said pair of sheet guide portions comprises a plurality of linear bodies disposed substantially on the same plane as each of said pair of sheet guide portions, and wherein water droplets can pass between said plurality of linear bodies, and a sprinkler provided outside said pair of sheet guide portions for sprinkling water droplets toward one of pair of said sheet guide portions to supply moisture to said cut sheet passing between said pair of sheet guide portions, wherein said plurality of linear bodies are thinner than the diameter of normal water droplets sprinkled by said sprinkler.

* * * * *